US007799170B2

(12) United States Patent
Shakespeare et al.

(10) Patent No.: US 7,799,170 B2
(45) Date of Patent: Sep. 21, 2010

(54) METHOD AND DEVICE IN A PAPER OR BOARD MACHINE LINE FOR STRAINING PAPER

(75) Inventors: John Shakespeare, Kuopio (FI); Taisto Huhtelin, Tampere (FI); Pasi Kekko, Toivakka (FI); Markku Lummila, Jyväskylä (FI); Pekka Pakarinen, Jyväskylä (FI); Vesa Vuorinen, Turku (FI); Matti Kurki, Jyväskylä (FI); Jaana Pienmäki, Muurame (FI); Asko Majori, Jyväskylä (FI); Kari Holopainen, Muurame (FI)

(73) Assignee: Metso Paper, Inc., Helsinki (FI)

( * ) Notice: Subject to any disclaimer, the term of this patent is extended or adjusted under 35 U.S.C. 154(b) by 980 days.

(21) Appl. No.: 10/598,730

(22) PCT Filed: Mar. 9, 2005

(86) PCT No.: PCT/FI2005/050069

§ 371 (c)(1),
(2), (4) Date: Oct. 31, 2006

(87) PCT Pub. No.: WO2005/088008

PCT Pub. Date: Sep. 22, 2005

(65) Prior Publication Data

US 2007/0175605 A1 Aug. 2, 2007

(30) Foreign Application Priority Data

Mar. 11, 2004 (FI) ..... 20040113 U
Mar. 11, 2004 (FI) ..... 20040385
Mar. 11, 2004 (FI) ..... 20040386

(51) Int. Cl.
*D21F 11/00* (2006.01)
*D21F 3/10* (2006.01)

(52) U.S. Cl. ..... 162/197; 162/270; 162/363; 34/425; 26/71

(58) Field of Classification Search ..... 26/70–79; 162/197, 270; 492/7, 21, 39, 40, 42, 49; 226/190, 192, 193; 34/425
See application file for complete search history.

(56) References Cited

U.S. PATENT DOCUMENTS 3,344,493 A * 10/1967 Telgheider ..... 26/99

(Continued)

FOREIGN PATENT DOCUMENTS

FI 20020068 1/2002

(Continued)

OTHER PUBLICATIONS

Smook, Handbook for Pulp and Paper Technologists, 1992, Angus Wilde Publications, 2nd edition, chapter 17.*

(Continued)

*Primary Examiner*—Eric Hug
*Assistant Examiner*—Anthony J Calandra
(74) *Attorney, Agent, or Firm*—Stiennon & Stiennon

(57) ABSTRACT

In a paper or board machine drying line after the wire section, during dewatering a web's (W) width is affected in a direction crosswise to the web's traveling direction. Starting from an edge, at least one device (20A, 20B) brings about a force effect of a desired magnitude which is directed all the way to a desired arbitrary crosswise web position in order to modify web characteristics. A device in a paper or board machine line after the wire section has means for processing the web and for dewatering. The paper or board machine line after the wire section further has at least one device (20A; 20B) for directing a force effect at a desired partial area (WS) of the web (W) in the cross machine direction in order to modify the web's characteristics profile in the cross machine direction.

30 Claims, 17 Drawing Sheets

U.S. PATENT DOCUMENTS

| | | | | |
|---|---|---|---|---|
| 3,690,910 | A | | 9/1972 | Mahe et al. |
| 4,680,843 | A | | 7/1987 | Junk et al. |
| 4,680,873 | A | | 7/1987 | Fellers et al. |
| 4,799,318 | A | | 1/1989 | Hansson |
| 4,862,565 | A | * | 9/1989 | Damour ..... 26/99 |
| 4,980,979 | A | * | 1/1991 | Wedel ..... 34/458 |
| 5,084,137 | A | * | 1/1992 | Ilmarinen et al. ..... 162/272 |
| 5,943,906 | A | | 8/1999 | Shakespeare |
| 6,108,936 | A | | 8/2000 | Vuorinen |
| 6,200,422 | B1 | | 3/2001 | Shakespeare et al. |
| 6,343,240 | B1 | | 1/2002 | Shakespeare et al. |
| 2001/0020523 | A1 | | 9/2001 | Begemann et al. |
| 2002/0052700 | A1 | | 5/2002 | Shakespeare |
| 2002/0177919 | A1 | | 11/2002 | Metsala et al. |

FOREIGN PATENT DOCUMENTS

| | | | |
|---|---|---|---|
| SE | 8902854-2 | B | 11/1992 |
| SE | 517689 | C2 | 7/2002 |
| WO | 90/14467 | A1 | 11/1990 |
| WO | 97/49863 | A1 | 12/1997 |
| WO | 2005/088008 | A1 | 3/2005 |

OTHER PUBLICATIONS

Gullichsen ed., Process Control,1999, Fapet Oy, book 14, p. 153-158, and 166.*
Gullichsen ed., Papermaking Part 2, Drying, Fapet Oy, book 9, p. 89 and 95.*
International Preliminary Report on Patentability for PCT/FI2005/050069.
Search Report issued in PCT/FI2005/050069.
Search Report issued in FIU20040113.
Search Report issued in FI20040386.
Search Report issued in FI20040385.
English abstract of SE517689.
English abstract of CH676863 (corresponds to SE468217).

* cited by examiner

STATE OF THE ART

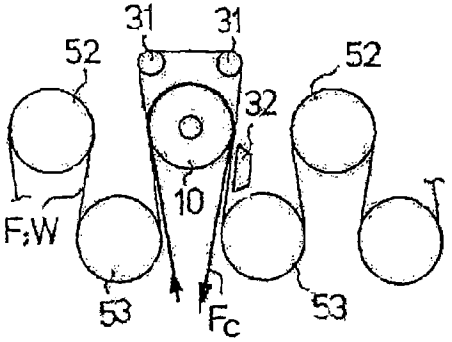
FIG. 6A
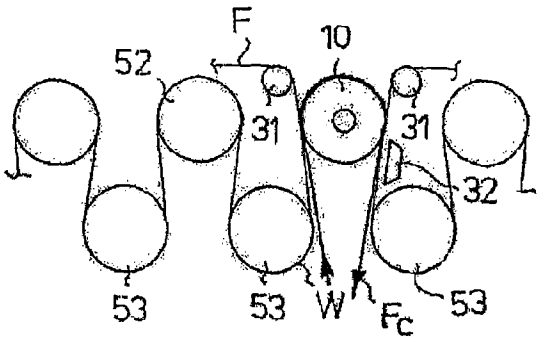
FIG. 6B
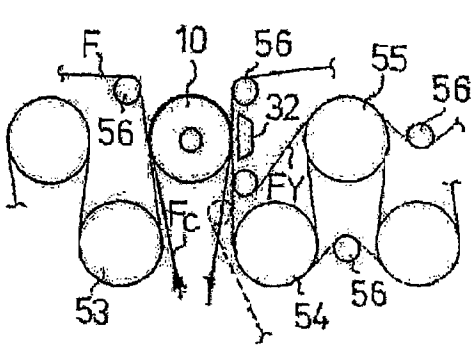
FIG. 6C
FIG. 6D
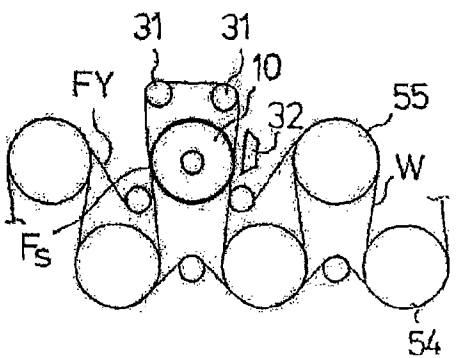
FIG. 6E

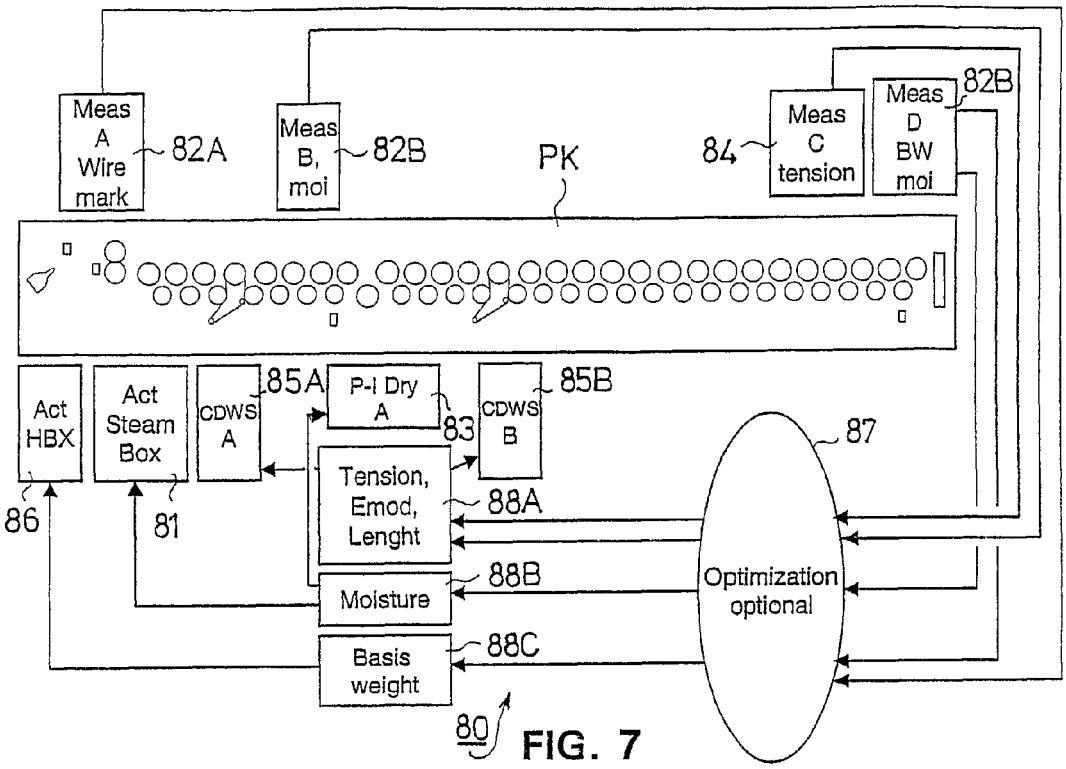
FIG. 7
FIG. 8
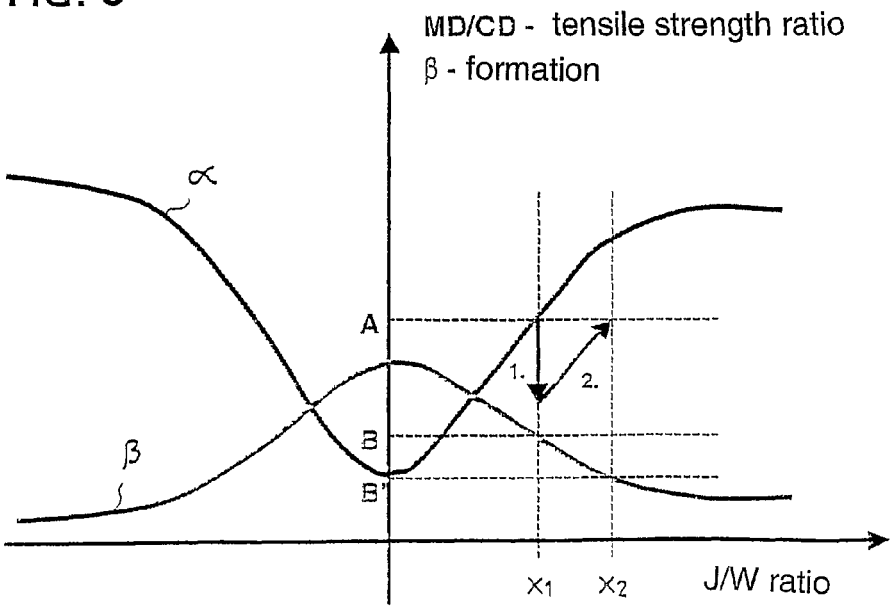

METHOD AND DEVICE IN A PAPER OR BOARD MACHINE LINE FOR STRAINING PAPER

CROSS REFERENCES TO RELATED APPLICATIONS

This application is a U.S. national stage application of International App. No. PCT/FI2005/050069, filed Mar. 9, 2005, the disclosure of which is incorporated by reference herein, and claims priority on Finnish Application Nos. 20040385, 20040386, and U20040113, all filed Mar. 11, 2004, the disclosures of which are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

Arrangements are known in the state of the art, wherein elements, for example, belts, are arranged in the edge areas of the web and these are used with the aid of suction and/or blowing actions to keep a hold on the web edge in order to eliminate the shrinking effect caused in the cross machine direction as the web is drying. Such arrangements are presented in Printed Patent Specifications SE 440518, 462171, 468217, 517689 and in the published international application WO 90/14467. These known arrangements are rather complicated and one problem in them is that in them the power effect extends over the entire distance of the web in the cross machine direction, whereby it is not possible to control the web's shrinking profile in the cross machine direction with their agency. Thus, with state-of-the-art arrangements the effect is reducing on the entire shrinkage level while at the same time efforts are made to straighten out the edge profiles.

Known in the state of the art is also Printed Patent Specification FI 863614, from which a linearly movable end bearing housing is known.

For spreading out a paper web to the sides to straighten the web such roll solutions are known, wherein the roll surface is provided with oblique grooves on both sides of the roll's central axis. The grooves hereby bring about a spreading effect towards the sides of the paper web, which effect can straighten the web's transfer towards the center and the web's folding.

Published WO Application 97/49863 presents a method and device, where the web is dried and cooled by transporting the web over a blowing device's curved periphery, from which blowing device blowing actions are directed at the web in order to bring about a support zone's backup zone and where moist exhaust air is sucked from the backup zone to inside the blowing device and where edge supports are arranged at each end of the blowing device to support the web and the edges of the support wire supporting the web and where the web is spread out in the cross machine direction by directing the edge supports into an opening angle in relation to the web's direction of travel. In the equipment known from the WO publication, the web is attached at the edges with the aid of special holding wheels provided with suction, that is, with the aid of spreading elements, and the central area of the web is dried with the aid of fixed foil nozzles located below. When located at the beginning of the drying section, such equipment allows wet-spreading of the web, which takes place with the aid of wheels located at the end of the space and provided with suction. The wheels suck and hold the web and the web can be spread out with the aid of the wheels' setting, which is directed outwards. It is a problem with this known solution that the contact-free backup zone does not allow directing of the spreading out. Thus it is an objective of the invention to provide an improvement of this arrangement and to develop it further, whereby the above-mentioned problem will be eliminated.

During all of the history of paper and board making the web's edge areas have posed a problem, in which edge areas shrinkage and rigidity characteristics in the cross machine direction have been inferior to those in the central part of the web. The problem has been especially prominent in single-wire transfer drying sections and it will be a significant factor when making drying sections for high-speed machines, where the above-mentioned smoothness of cross-section profiles is a significant advantage in the quality characteristics.

Controlling the edges is thus a problematic area in papermaking. As single-wire transfer drying sections become more popular, shrinkage and material characteristics in the cross machine direction of the central area have been made quite uniform and owing to this the web is of quite a uniform quality except in the edge areas. In certain cases strong changes, which occur in quality characteristics and in drying-shrinkage and which are concentrating in the edge area, may even be so big that the characteristics of the paper will be so poor that no marketable product is obtained from the web's edge areas, that is, may lead to rejection of customer rolls cut from the edges in the slitting.

As is known from the state of the art, especially in single-wire transfer drying sections of papermaking machines a shrinkage profile having a uniform central part occurs in the web in the cross machine direction and increases strongly in the edge areas. A sharp shrinkage profile at the edges has the result that, for example, in the case of board it is not possible to use the edges in further processing, but the edges are cut off in most cases. This causes production losses and reduces the efficiency of the machine.

Proportioning of the web's fiber orientation to the runnability is a problem in known state-of-the-art solutions. Such a web has the most advantageous runnability, where the fiber orientation is strongly in the machine direction, whereby the distribution ellipse of the fiber orientation is very elongated in the machine direction. However, more fiber orientation in the cross machine direction is a requirement with certain paper grades, and the distribution ellipse describing it thus becomes rounder, for example, in order to ensure the web's dimensional stability, which has led to compromises as regards runnability. Less fiber orientation in the machine direction of fine grade paper, for example, copying paper, which has strengthened the dimensional stability, compared e.g. with newsprint, has caused poorer runnability, which has also been described with the distribution ellipse of the fiber orientation, which is oval for newsprint and rather round for copying paper. In the machine direction, an oval distribution ellipse of the fiber orientation means more shrinkage in the cross machine direction, because there is less fibers in the web's cross machine direction that would prevent shrinkage from taking place in the concerned direction.

The problems known from the state of the art and relating to profile control combined with the drying shrinkage of the edges will be more pronounced along with increasing machine velocities and higher draws used in the machine direction, because the web's edges have a poorer ability to resist the power effects increasing along with the speed, whereby they will stretch and the web has thus to be tightened in the machine direction according to its looser parts, although draws have an adverse effect on the quality characteristics of the paper. As speeds have become higher, it has been necessary to shorten the first drying groups, so that a draw in the machine direction is obtained in the very wet web in early drying by always running later drying groups faster than the preceding one.

It is a problem in known state-of-the-art arrangements when using CD control in the shrinkage control that the control steps are disturbed by the variation of shrinkage. In this regard reference may be made; for example, to the doctor's thesis entitled John Shakespeare: Identification and Control of Cross-machine Profiles in Paper Machines: A Functional Penalty Approach, Tampere University of Technology publications 352, 2001 (ISBN 952-15-0719-5, ISSN 0356-4940).

On the other hand, as regards the state of the art, reference can be made to the measurement and adjustment of the cross machine profile and to the measurement and adjustment solutions for the shrinkage profile and elongation profile or web tension, which are described, for example, in the following publications: FI 990217, FI 992849, U.S. Pat. No. 6,200,422, FI 20020068, U.S. Pat. Nos. 5,943,906 and 6,343,240. The problem in these known solutions is that it is not possible with the aid of these known methods to control the deformation (shrinkage/elongation profile) of the paper sufficiently. On the other hand, a variation of the shrinkage profile also makes the result of several adjustments deteriorate, so that even for this reason it would be worthwhile to maintain both the elongation profile and the shrinkage profile as constant as possible in such a way that the process models used by the adjustment and the real measurement result would correspond with each other. The best performance is hereby obtained from the adjustment.

SUMMARY OF THE INVENTION

It is an objective of the invention to control the paper or board web's properties and quality profiles in the cross machine direction in relation to the traveling direction and to direct the force effects brought about for their correction in the cross machine direction in relation to the web's traveling direction with the overall situation being taken into account.

It is an objective of the invention to level out the paper or board web's properties in the cross machine direction in relation to the traveling direction, the shrinkage profile in particular, so that near the edges the shrinkage profile is as straight as possible and of a standard close to the corresponding shrinkage profile in the central part of the web. In addition, it is possible to raise the standard, for example, of the entire rigidity profile in the cross machine direction in such a way that there is more effect on the edges.

It is an objective of the invention to provide a method for managing and controlling the paper's quality profiles in the cross machine direction in combination with a control of the drying shrinkage of the edges.

It is an objective of the invention to provide a method and a device for solving problems especially relating to the control of edge shrinkages in a paper machine line. The invention especially aims at a control of the web's quality profiles in the cross machine direction in combination with a control of the drying shrinkage of the edges.

Since controlling the edges in paper and board machine lines becomes an increasingly critical factor in future paper and board machine lines, it is an objective of the invention to present a method and a device allowing control of the paper's quality profiles in the cross machine direction.

In the method according to the invention, a force effect is brought about of the desired magnitude beginning from the web's edges and directed at a desired position of the web in the cross machine direction, for example, spreading, whereby the web's characteristics are modified by at least one device causing the force effect. In addition, an area may remain in between the web's edge parts, to which no force effects are directed.

In connection with the invention, the force effect is provided by spreading elements, according to one advantageous application. According to an advantageous application example, the force effect is brought about in order to bring about a spreading effect of holding wheels "shaft-mounted" on the neck of a suction roll and operated independently and also with the aid of the suction-effect area of adjustable vacuum holding wheels, the affecting time, the toe-out and a zoned suction/blowing roll, whereby the force effect is directed all the way to the roll's suction zone. The holding wheels may also be pivoted on the roll's shaft without a drive. According to one more additional advantageous characteristic feature, the toe-out of the holding wheels can be adjusted advantageously mechanically in both directions at the same time and equally or separately, when required. It is also possible to arrange the toe-out hydraulically/pneumatically, with an electric actuator separately or simultaneously.

According to an advantageous additional characteristic feature of the invention, the holding wheels can also be moved to the desired position according to the trim, that is, the web width. According to an advantageous additional characteristic feature of the invention, it is also possible to use a mutual speed difference of the holding wheels, whereby the desired edge can also be subjected to a force effect partly in the machine direction and folding of the edge can be prevented and the web's runnability can be promoted with the aid of the roll.

According to an advantageous additional characteristic feature, the suction zones of the suction roll can be provided with a blowing option in order to adjust the force effect on a zone basis.

According to an advantageous additional characteristic feature, holding of the web is implemented in the area of the spreading elements with the aid of friction forces.

According to an advantageous additional characteristic feature of the invention, the holding wheels' areas of effect are formed by separate suction sectors, of which there may be, for example, from one to eight and which can be turned on and off as required. It is hereby possible to spread out constantly all the way to the desired sector. It is also possible to schedule the spreading, for example, two sectors of spreading and then one sector without suction, that is, spreading, and two further sectors of spreading, and finally there may again be sectors without suction.

The effective time of the force effect device for use in connection with the invention is formed by the running speed of the machine, by the roll dimensions chosen when designing the machine and by the agency of the above-mentioned sectors.

According to an advantageous application of the invention, spreading out of the web is carried out at an optimum spreading speed and spreading quantity in the cross machine direction in such a way that the profile of the web's material characteristics in the cross machine direction is of the desired kind, typically as uniform as possible.

With the arrangement according to the invention, a spreading time of 0-5 s is preferably used, most preferably 0.1-2 s, with a machine running speed of 300-1800 m/min. The spreading quantity brought about by the force effect device is preferably 0-5%, most preferably 0.5-2.0% of the web width.

With the advantageous arrangement according to the invention, the force effect of spreading affects most powerfully in the desired area, whereby the shrinkage profile or CD rigidity profile is made to become uniform. When desired, the invention may also be used, for example, to raise the overall level of CD rigidity.

According to an advantageous feature of the invention, the rigidity in the cross machine direction of the web's desired partial areas in the cross machine direction, especially of edge parts, is controlled by directing spreading at them when the web's dry-matter content is above 20%, with paper most suitably 45-75% and with board most suitably 30-60%. This in combination with a control of the web's edge parts gives an excellent ability to control the characteristics of the web's desired partial areas in the cross machine direction, especially of edge parts, during/after drying.

An increase in the web's dry-matter content can be utilized as a basis for the location of the spreading device or possibly of several devices, because, for example, with a wetter web the force effect is directed just at the edges of the web. On the other hand, the web's edges will dry a little earlier, whereby with increasing dry-matter the extension of the force effect will grow towards the central part of the web.

However, with arrangements according to the invention a control, for example, a correction, is provided of desired targets of quality profiles in the cross machine direction, especially of non-linearities of the edges. With the system according to the invention, improvements are provided/the characteristics in the cross machine direction are affected without any adverse effect on the web's characteristics in the lengthwise direction, because spreading of the web in the cross machine direction within the dry-matter range presented above will improve and make uniform, for example, the modulus of elasticity, the CD rigidity, the smoothness, the formation indirectly and the absorption profile.

With the equipment according to the invention, significant strength and quality improvements are also achieved, because fibers deviating from the machine direction are put straight without any significant recovery. When directing the force effect in the cross machine direction at the fiber network formed by a paper web, it is advantageous also to maintain the web's draw in the machine direction, because the force impulse brought about in the cross machine direction will also proceed somewhat in the machine direction.

In the method and device according to the invention, web characteristics are changed by beginning from the edge and directing spreading of the desired magnitude all the way to the desired web position in the cross machine direction and by modifying web characteristics by at least one device bringing about a force effect. According to the invention, by improving the web's quality profiles savings are achieved in the use of pulp and/or the runnability potential is increased without any adverse effect on paper characteristics.

An advantage achieved by the invention is that especially the distribution ellipse of the fiber orientation of the edge areas can be made more circular by the method and device according to the invention, that is, from an orientation strongly in the machine direction the rigidity in the cross machine direction can be increased, whereby in the early part of the paper or board machine such a web can be run, whose fiber orientation is strongly in the machine direction and later the rigidity in the cross machine direction can be changed as desired, that is, the fiber orientation ellipse can be made more circular.

The invention also allows connection of the profile runnability to the j/w ratio, which indicates the speed difference of the lip jet and the wire, that is, clenching of fibers to the wire or the draw of the wire in relation to the fibers, and to the dependence of formation, whereby it is possible to use a higher j/w ratio and thus achieve better formation at the same time. A weakening and possibly a breaking off of detrimental structural characteristics and functional interdependencies are thus achieved with the invention.

Several significant advantages are achieved by the invention. By improving the web's quality profiles the device helps the papermaker to save in his use of pulp and/or to increase the runnability potential without any adverse effect on the paper's characteristics. The arrangement according to the invention makes it possible that the strength ratio in the machine direction/cross-machine direction can be reduced, that is, the strength characteristic in the cross machine direction can be increased. In addition, the web can be run on the wire section with a higher j/w ratio, whereby the strength/runnability in the machine direction will be improved. Furthermore, the bottom quality will improve, that is, the web formation improves when running with a higher j/w ratio. In addition, the shrinkage profile in the cross machine direction will improve significantly.

According to an advantageous application of the invention, the paper's dimension in the cross machine direction is changed/adjusted in a controlled manner to be as desired. The basic principle is that after the spreading the web's dimension in the cross machine direction will be bigger than before the force effect device carrying out the spreading, preferably either half divided by the central line of the web before the roll or device just at the holding area is thus smaller than either half after the roll as the central line continues in the same direction through the spreading process of the force effect device.

To this advantageous application of the invention it is advantageous to join also actuators at the wet end, and according to one advantageous application as the web proceeds from the wet end to the dry end devices located both at the dry end and at the wet end are used in the web control method. At the wet end, it is possible to use actuators for profile control in the cross machine direction, for example, a system used for controlling the dilution water of the dilution headbox, in connection with the method according to the invention. A change in the actuator at the wet end brings about a change in the process, whose effect will be noticed as a change in the web. The effect of a change in the actuator on the profile measured in the web is important to the control of the process, because the control, control or optimizing of the cross machine profile in particular, uses response models describing this effect. For example, with the aid of dilution valves of the dilution headbox the basis weight profile in the cross machine direction is controlled in a manner known as such. It should be especially noted in connection with the invention that by using an actuator it is possible to form an excitation signal, with the aid of which broadening and shrinking of the web is controlled. The use of such an excitation signal is known as such, as is the detection of the change it causes and determination of the shrinkage profile and directing actuators at the measurement profile. In this manner it is possible to remove a width part known as such from the web, because the quality characteristics of the web's edge are not sufficient for further processing. In this connection it is also possible to use wet end measurement for measuring the profile before the spreading roll. A second measurement is hereby performed after the spreading roll in order to find out the changed profile.

In an advantageous application of the device according to the invention, a holding device is used to hold on to the web in the manner described in the invention at least in the middle, but also elsewhere when desired either all the time or in a manner determined by the control. In connection with the holding device there is a device spreading the left edge of the web and holding on to the left edge of the web in accordance with the invention in order to bring about spreading. The length of spreading is determined either manually or based on optimizing instructions provided by the control system of the invention. Likewise, the spreading angle (toe-out) to be used has already been determined or it is controlled manually or by an optimizing device. Attached to the holding device is also a device spreading the right-hand edge of the web and functioning in the same manner as the device spreading the left edge. The web will typically shrink before the dry end measurement equipment located at the dry end, whereby the spreading brought about in connection with the invention is used with the aim of eliminating the effect of shrinkage, that is, with the aim of making the shrinkage profile straight or at least into a shape that has been considered good. The measurement equipment at the dry end is used to measure the characteristics of the paper, such as the basis weight, moisture, etc. The web measurement may also be carried out immediately after the spreading device, whereby the spreading can be controlled also based on this measurement. The guiding value for spreading may hereby come from the dry end control device either set by the operator or determined by an automatic control action, for example, by feedback control or optimization.

It is also possible to use both measurements at the same time and give prominence to measurement in a manner known as such, for example, in such a way that after the measurement following after the spreading the web is immediately protected against a too powerful local spreading and the final shrinkage/spreading profile is allowed to deviate from the optimum profile. A control of this type can be implemented by technology known as such or, for example, as concluding by the operator.

In addition, it is possible to measure the web width and the impact of the excitation signal formed by the actuator at the wet end. Such individual control devices may also be located in connection with the invention, which control the actual processing equipment in a manner determined by a control system of an upper level. Such an individual control device may also be a built-in function of the device. In connection with the method according to the invention it is also possible to use other adjusting devices and controls relating to the cross machine direction of the web, for example, adjustment of the basis weight cross-profile, which is done based on the post-drying basis weight measurement by controlling either the lip profile of the headbox, for example, the opening of the lip in the cross machine direction, or by controlling the dilution ratio and this way the dilution valves. As is known, this can also be done based on the basis weight measurement before the drying section or with the aid of both in a manner known as such. In this context it is also possible to use adjustment of the moisture or of tension or a combination of these both. According to the invention, it is possible to control the shrinkage profile, the basis weight profile, the moisture profile, the tension profile and together with or some of the three last-mentioned together with the shrinkage profile by using profile adjustment methods known as such. Especially central from the point of view of the invention is a joint adjustment and/or optimization of the tension and shrinkage profiles. Such software is also advantageously used in connection with the invention, which provides in a manner known as such the excitation signal required for determination of the shrinkage. Using this excitation signal in shrinkage control is new and inventive, among other things, in the context of the invention. Such software is also advantageously used in connection with the invention, which calculates the web's noted shrinkage profile by utilizing the excitation signal of the wet end actuator and measurement information produced by the measurement equipment of the wet end, at least spreading information, and spreading information of the dry end measurement and the impact of the excitation signal in the measurement profile. In this way it is possible in the context of the invention to form a directed measurement profile, from which the effect of spreading and shrinkage has been eliminated for the adjustment controlling the wet end actuator, which is preferably made as fast as possible. Another central signal to use is calculation of the shrinkage profile, where the shrinkage profile comprises both the effect of the spreading equipment and the effect of the drying shrinkage, in which context the shrinkage profile is controlled and the shrinkage profile is used for allocating measurement profiles at the same time according to the invention. In connection with one feature of the invention, the optimization brought about by the actuator is also essential, which is formed as such by known sub-factors. In this connection use is made of feedback control methods known as such or of optimizing based on a cost function or rules of conclusion/calculus based on fuzzy control or guiding controls based on neuro-network models. Correction of the profile in the cross machine direction is done either once optimizing or sequentially. Physical models for the paper's structure and behavior are known as such or they are simplified models, which can be determined by process tests, and the necessary mathematics is also known as such. The control is typically done more slowly than control in the CD direction, but the arrangement according to the invention also allows quick control.

In an advantageous application of the method according to the invention, the web's real widening is followed, so that any slipping of the spreading and the determination of desired optimum conditions can be adapted in the different situations during running. According to an advantageous application, the web width is measured before and after the force effect by a suitable arrangement, for example, by a laser from the bottom surface of adjacent rolls from both edges, in order to find out the real widening of the web at different positions in the cross machine direction and changes in the place of the web. In this way it is possible to verify that the desired spreading has taken place at least towards one edge from the central line. According to some advantageous additional features, the measurement may also be carried out from the roll's top surface by camera technology or possible changes in a vacuum roll's hole pattern can be followed by infrared agency or by wire marking etc. A measurement frame is preferably in connection with the invention and it can be placed, for example, after the drying section, and from normal basis weight and ash profile measurements as well as from measurement results obtained from the drying section it is possible to find out whether spreading has taken place in the method according to the invention in the desired manner and the spreading can be controlled further in the desired direction. Thus, in the method according to the invention it is possible when required to follow desired changes in the quality profile, for example, the modulus of elasticity and/or the extension stiffness, elongation in the cross machine direction. The elongation can be observed, for example, from a change in the wire marking pattern after the drying section. In the arrangement according to the invention, advantageous quality profiles can be brought about even with small spreading, but with a suitable time-dependent spreading impulse. In the invention, the improvement in quality profiles and in control profiles takes place in the web's edge area in particular, whereby the allocation of the concerned measured profiles to the web is improved owing to less shrinkage.

When the web's shrinkage profile is made uniform by applying the invention, allocation of the actuator to the measurement becomes easier and more accurate (mapping). In this way the effect of actuators in various places of the machine will be of a similar kind. Achieved improvements in the control of a papermaking machine in the cross machine direction are the following, among others. Fewer parameters are needed to characterize the process, the process is easier, quicker and more accurate to identify, complexity is reduced in the analysis of controls and in problem-solving, which means that the process can be better controlled.

The invention allows a more uniform web, which withstands draw better, and thus allows increasing the speed and less breaks. On the other hand, more uniform web characteristics guarantee a paper of a more uniform quality and thus a paper which can be better utilized, whereby the paper quality perceived by the customer is improved.

The invention also allows increasing production, because the speed can be increased, whereby more production is achieved and paper of a more uniform quality along the whole width of the web.

A possible application of the invention could be one where known state-of-the-art solutions for holding the web are combined also in connection with the holding wheels according to the invention, whereby it would not be necessary to have suction in the holding wheel, as the web would be held in place with the aid of a supporting belt pressing the web edge against the holding wheel.

Such an application of the invention is also possible, where needles or equivalent holding elements comprise a holding wheel and penetrate through the web edge and keep the web mechanically on the surface of the holding wheel during the spreading.

According to an advantageous application of the invention, a roll is used in connection with the device, which roll surprisingly comprises at both its ends separate end pieces having rotated shells, which are used to hold the paper edge and the web is pulled quickly in the cross machine direction at a suitable dry-matter content. The end pieces with rotated shells can be turned at a desired angle in relation to the web's traveling direction. By this adjustment of the angle the spreading of the paper web is controlled as well as the force, which draws the web, such as a paper web or a board web, to the side, whereby the web's shrinkage profile in the cross machine direction is affected and controlled. By controlling the end face of the end piece and the speed of rotation of the shell part relating to the end piece that force is affected, which is directed at the web W in its edge area, and thus it is possible to control the web's W characteristics, such as the shrinkage profile.

The turning mechanism for end pieces having a shell rotated with the aid of a special pivot according to an advantageous additional feature of the invention can be implemented efficiently by saving space and costs. The shell can be perforated and a vacuum box can be arranged in connection with the shell to direct a holding suction from the vacuum boxes through the perforation to grooves in the shell surface and through these to the paper web, the board web or equivalent.

The pivot for tilting/turning is formed by two cylindrical bushings and in the inside surface of the outermost of these a curved shape is worked out and a corresponding shape is made in the outside surface of the inner bushing, and the center of their radius is in one edge of the end piece's roll shell. The equipment is designed in such a way that it can be tilted when required. Thus, the end pieces comprise a rotating motor of their own and a tilting actuator of their own. The motor rotating the end piece's shell and the peripheral devices are attached to the tilting end piece. When an end piece is to turn from its basic position at point zero into a certain angle, this is done supported by the concerned pivot by the tilting actuator, which may be a cylinder device, an electric motor, etc.

High web speeds are also taken into account in the dimensioning of the gear. In technical terms, for example, a big gearwheel requires special know-how also in view of manufacturability.

The rotated end piece of the roll, that is, the so-called end gear is also characterized in that it can work in a hot and moist environment. Environmental conditions are taken into account in the operation and raw materials of bearings, seals and the motor. It is also special that elements required for suction can be placed in the outer housing of the gear. The matter is taken into account in the construction solutions and it is presented in the protecting claims of the appended application.

A papermaking machine means a papermaking machine, a board making machine or something equivalent. In this application, web means a paper web or a board web or an equivalent web.

In the following, the invention will be described in greater detail by referring to the figures in the appended drawing, but there is no intention to limit the invention in any way narrowly to the details shown in the figures.

BRIEF DESCRIPTION OF THE DRAWINGS

FIGS. 6A-6I show schematically various possible locations for the device according to the invention in the drying section of a papermaking or a board-making machine.

FIG. 7 shows schematically an arrangement for implementation of the method according to the invention in a papermaking machine.

FIG. 8 shows schematically a jet wire ratio in comparison with a tensile strength ratio in the lengthwise/crosswise direction.

Figure 13A:
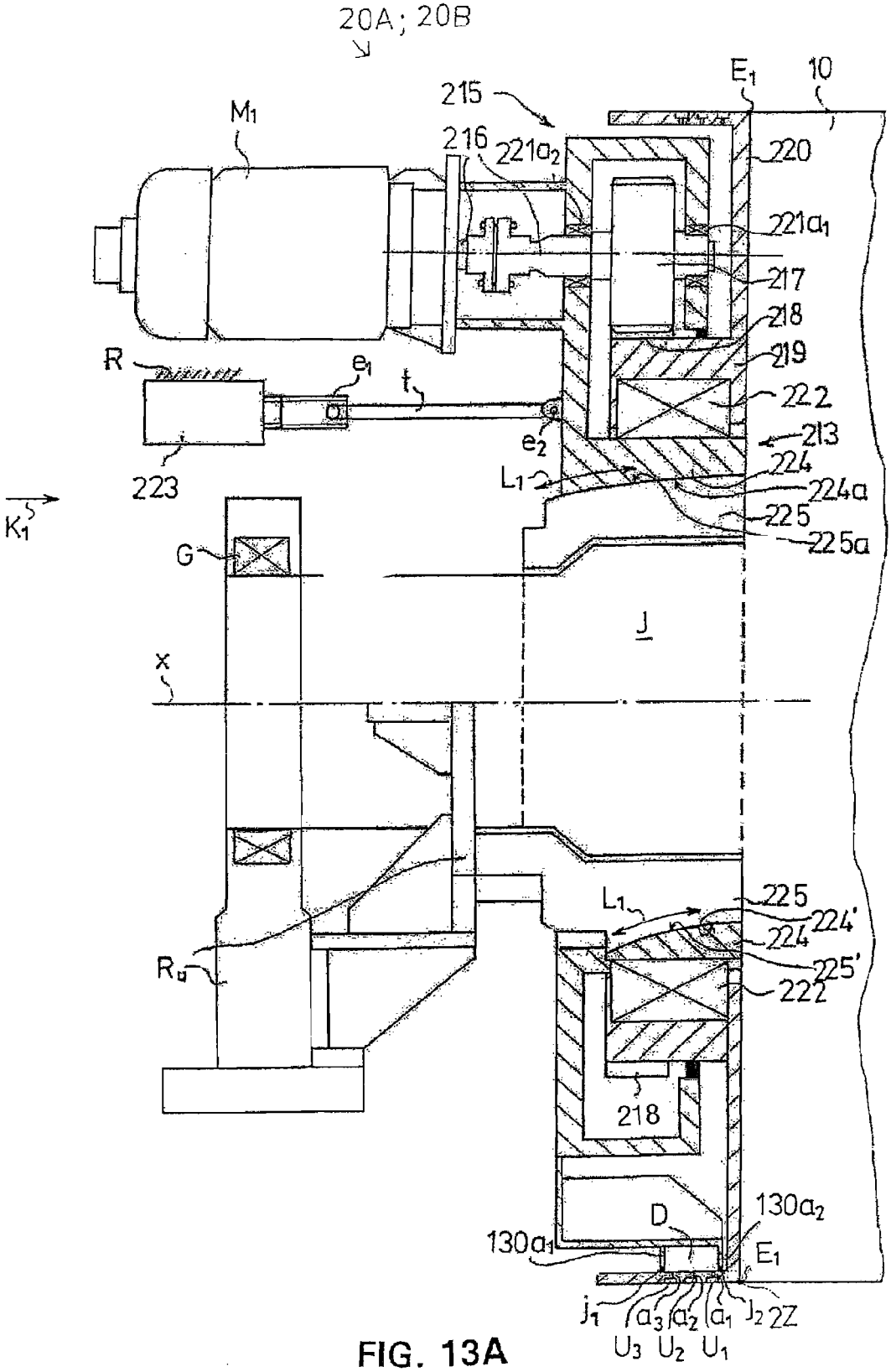
FIG. 13A is a cross-sectional view of the end piece of a roll according to an advantageous application.
Figure 14A:
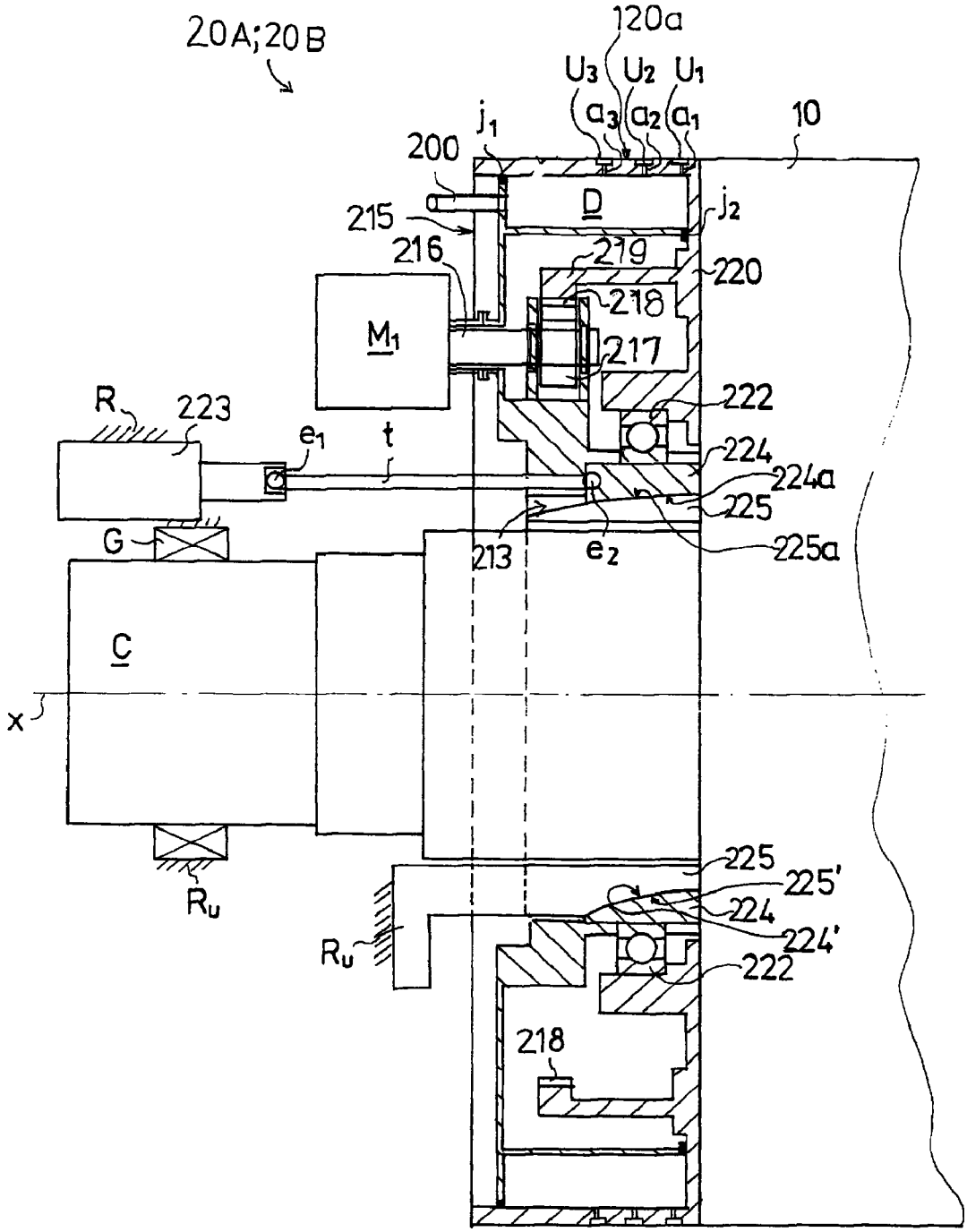
FIG. 14A is a view of an application of the equipment according to the invention in a non-tilted position.
Figure 14B:
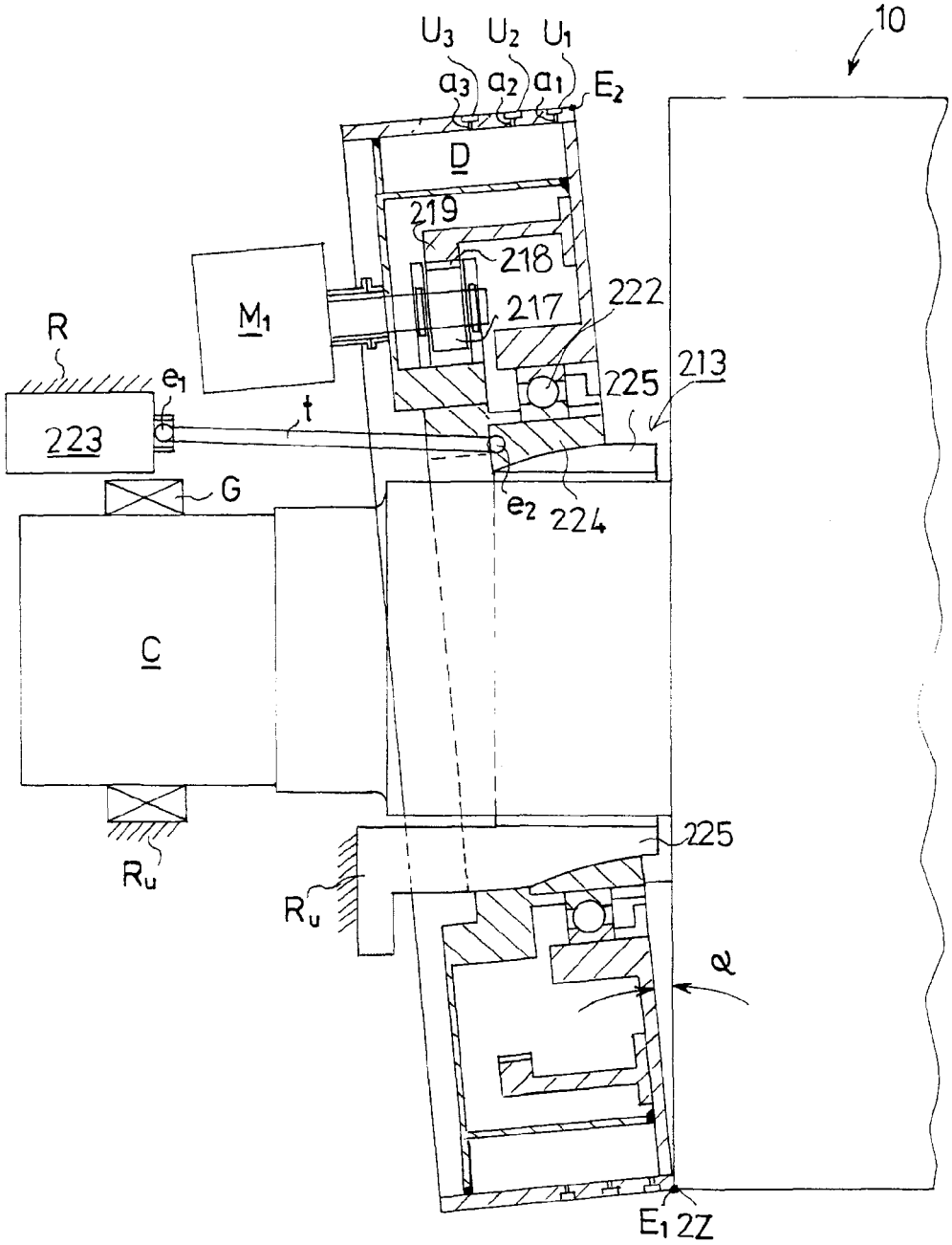
FIG. 14B shows an end piece tilted by approximately 5° around its turning point E. The presentation 14A, 14B is a longitudinal cross-sectional view of the end piece.

The embodiment shown in FIGS. 14A and 14B differs somewhat from the embodiment shown in FIG. 13A.

Figure 15B:
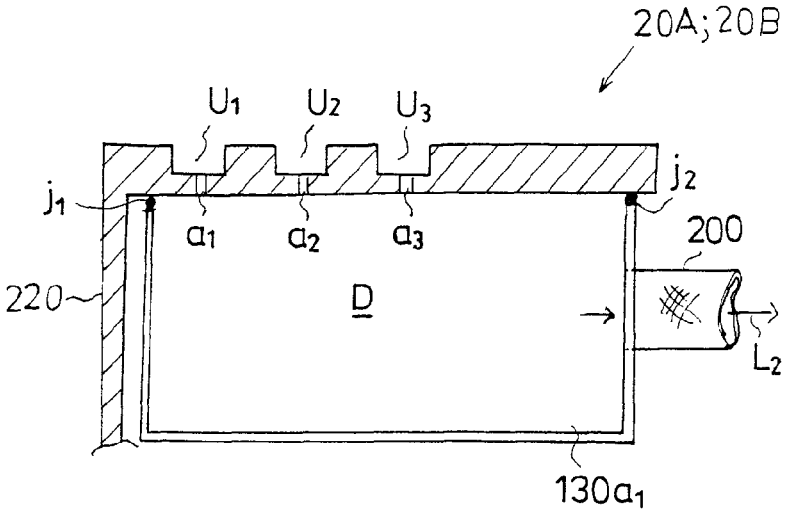
Figure 15A:
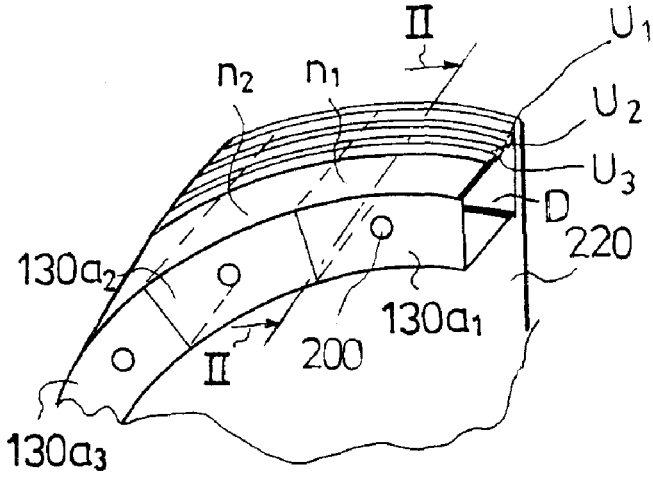

FIG. 15A is an illustrative and partial view of a vacuum box in connection with an end piece's shell part.

FIG. 15B is a section along line II-II of FIG. 15A.

Figure 16:
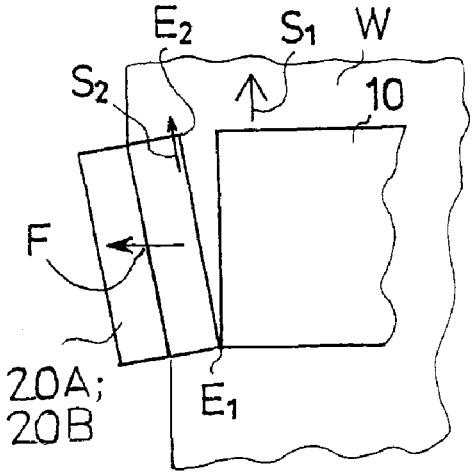

FIG. 16 illustrates side draw.

Figure 17A:
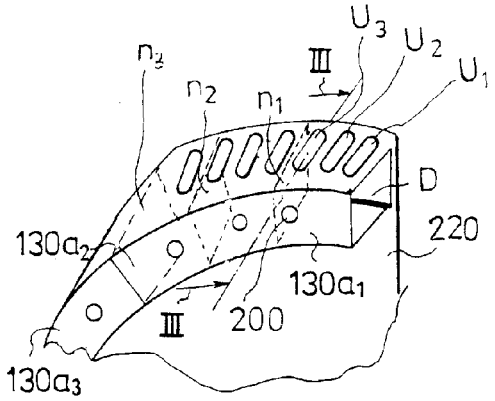

FIG. 17A shows the shell part of an end piece provided with crosswise ending grooves.

Figure 17C:
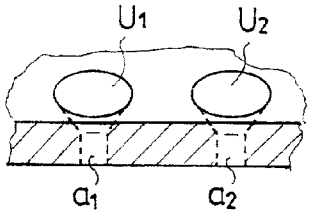
Figure 17B:
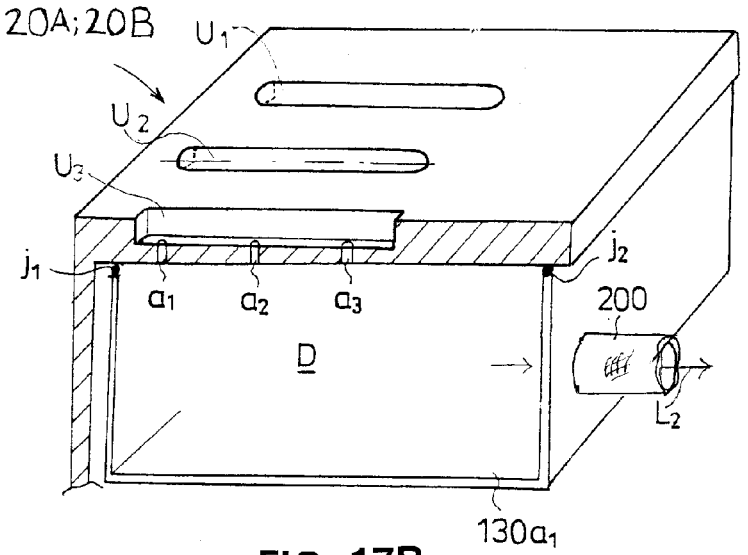

FIG. 17B shows a section along line III-III of FIG. 17A.

FIG. 17C shows forming of a groove by counter-boring.

Figure 18:
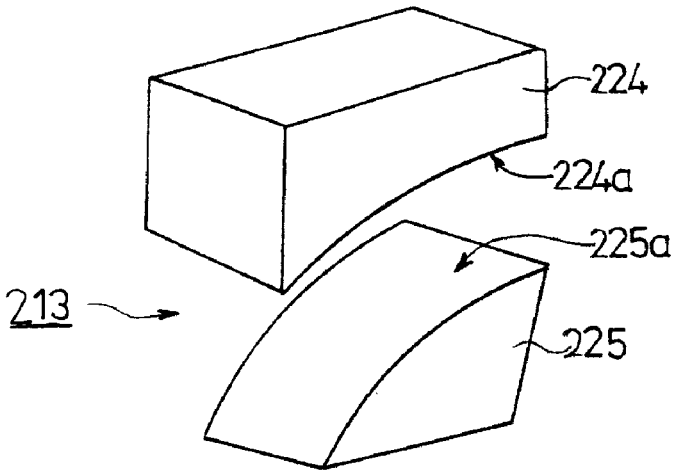

FIG. 18 shows a shape of curved surfaces 224*a*, 225*a* and also 224', 225'.

Figure 19:
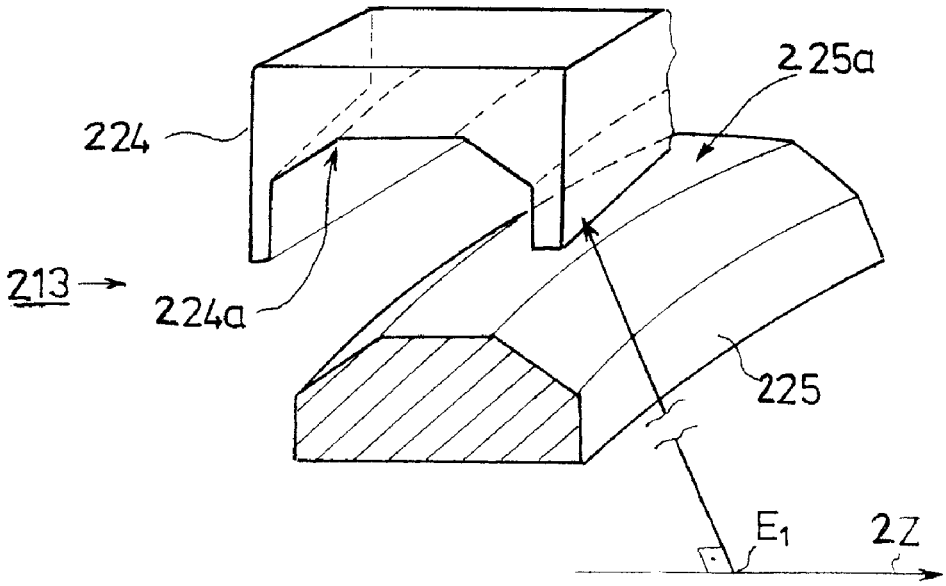

FIG. 19 shows another alternative way of forming the control surfaces 224*a*, 225*a* of bearing 213.

DESCRIPTION OF THE PREFERRED EMBODIMENTS

Figure 1:
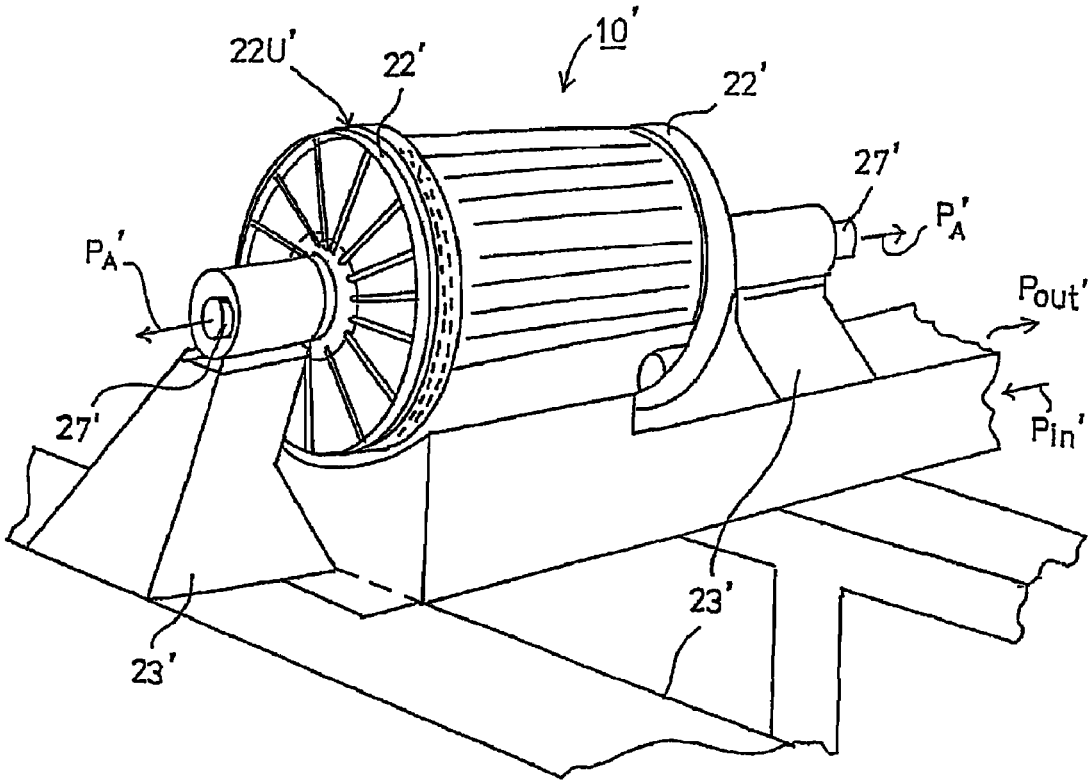
FIG. 1 shows a solution known in the state of the art.

The device shown in FIG. 1 shows the state of the art and it is a drum 10' or equivalent. Inside the drum 10' drying gas $P'_{in}$, is conducted, which is blown from holes made in the drum's shell to the surface of the web-like material, for example, a paper web to be dried. In this state-of-the-art arrangement, the web is conducted over the periphery of the blowing drum 10' or equivalent. The web to be dried in the method is supported at its edge areas by agency of a rotating edge support 22' located separately from the blowing drum at each end of the blowing drum 10', and in the method the supporting zone is sealed in the web's traveling direction by agency of the peripheral and/or friction surfaces of the edge supports 22'. The blowing drum 10' is fitted fixedly in its place with the aid of supporting structures 23'. As is shown by arrow $P'_{out}$, exhaust air is removed from the backup zone, and arrows $P'_A$ show an under-pressure effect arranged in the area of the edge supports. Edge supports 22' rotate around a shaft 27' and at the same time they seal the air system. For web feeding, a groove 22U' is arranged in connection with one end of the edge support 22' for web feeding ropes. Through shaft 27' suction $P'_A$ is arranged, through which the holding of the web caused by the edge supports 22' is added to.

Figure 4:
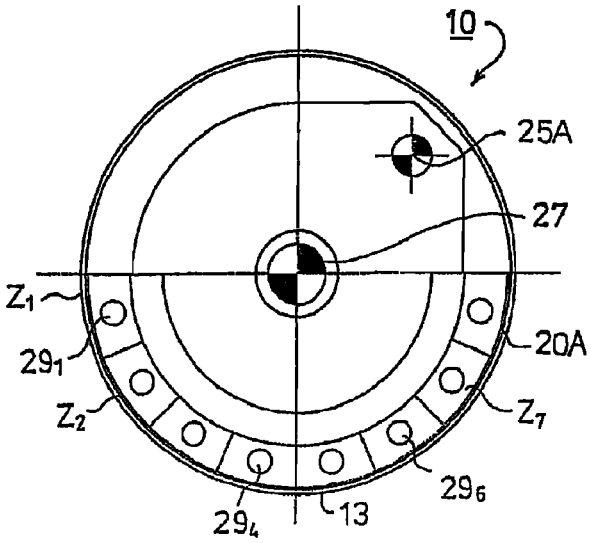
FIG. 4 shows schematically an end view of a roll according to the invention.
Figure 2:
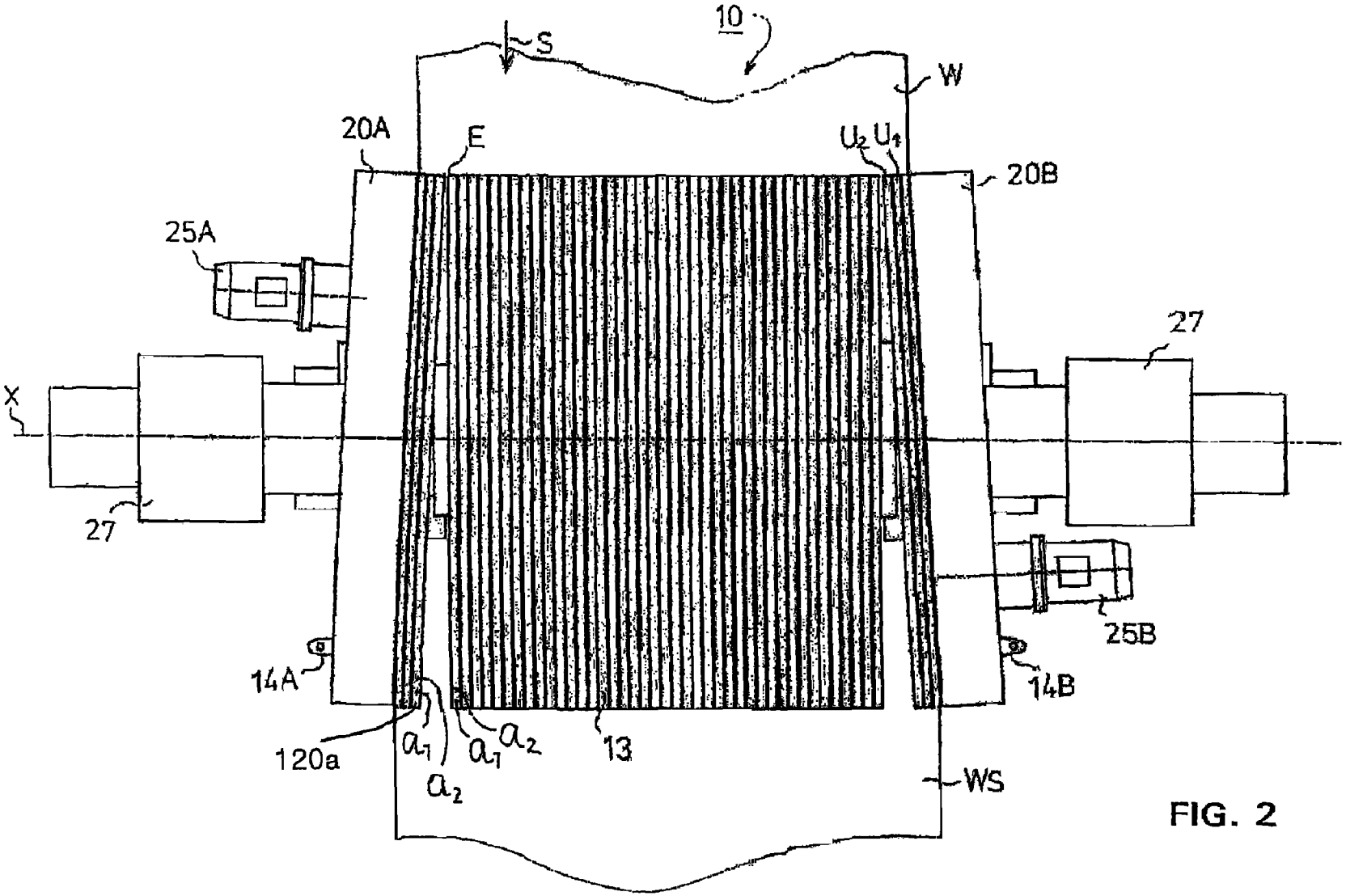
FIG. 2 is a schematic view of a roll for use in connection with the invention.
Figure 3:
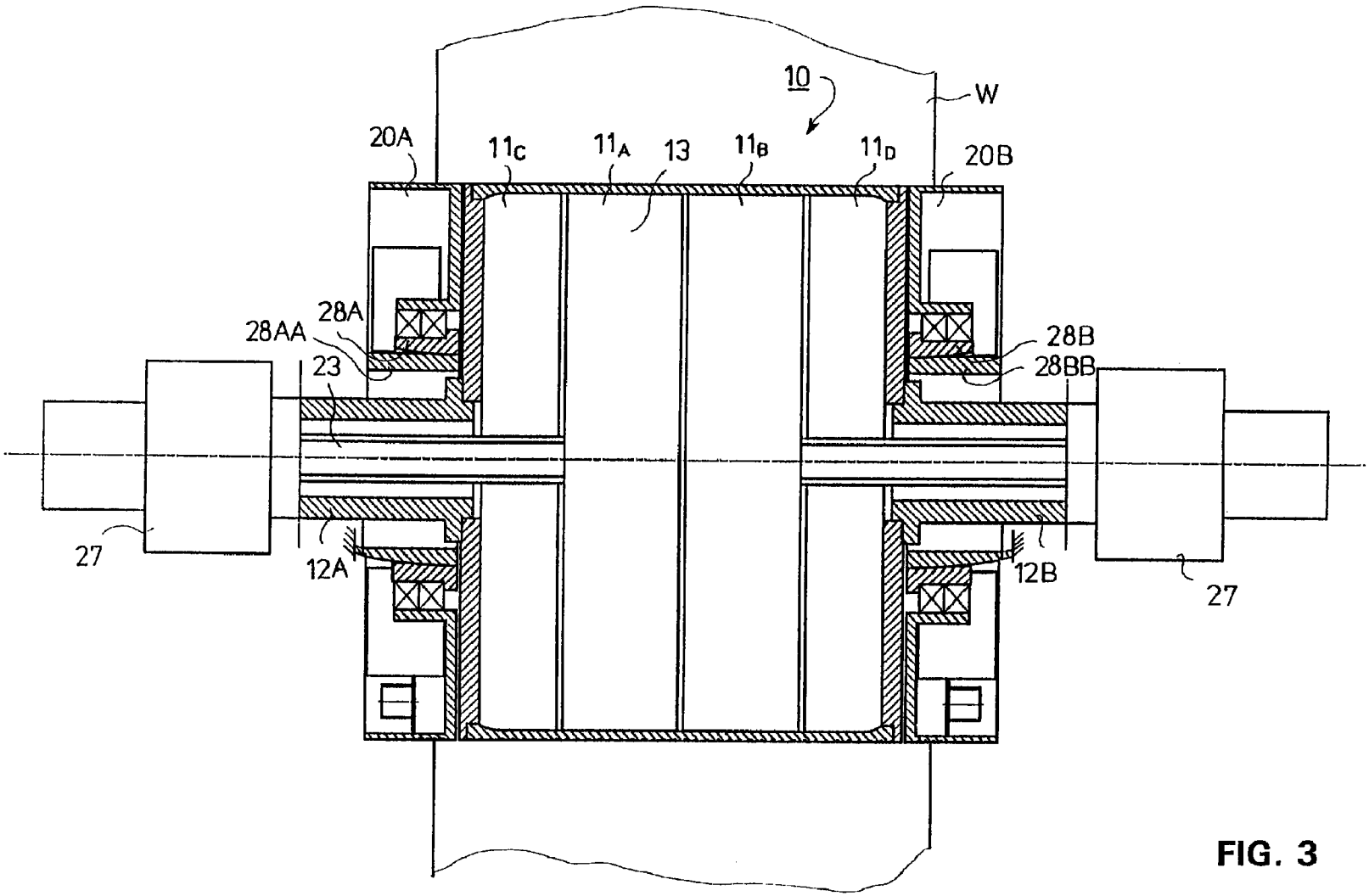
FIG. 3 is a schematic view of a roll for use in connection with the invention as a cross-sectional view in the lengthwise direction.

In FIGS. 2-4 the same reference marks are used for similar parts.

In an advantageous application example of the invention shown in FIG. 2, the device 10 according to the invention comprises spreading elements 20A, 20B affecting the edge areas of a web W and bringing about a force effect (i.e., strain). As can be seen in the figure, in order to bring about the spreading effect the spreading elements 20A, 20B are turned into an opening angle in relation to the web's W traveling direction S, whereby the desired spreading effect is directed to the edge areas of web W. Reference number WS indicates the web's W edge area, which has been subjected to the spreading effect. Spreading elements 20A and 20B comprise positioning assemblies 14A, 14B, with the aid of which the quantity of spreading is controlled, as well as drives 25A, 25B.

As is shown in FIG. 2, the roll 10 comprises shafts, bearings 27, a roll shell and spreading elements, that is, end pieces 20A, 20B at both ends of roll 10. According to the invention, the end pieces 20A, 20B can be tilted around a turning center $E_1$. When an end piece 20A, 20B is tilted its shell part rotated by a motor 25A, 25B will also tilt. Bearings 27 support the roll 10 and function as rotation bearings. The roll's 10 roll shell rotates rotated by the shaft and its central axis is indicated by the letter X. Such an embodiment is also possible, where the bearings 27 are idle bearings and trunnion bearings, and the roll's 10 shell rotates on bearings located in between the shell and the roll's 10 end flange. Roll 10 may receive its rotating drive from the wire or the roll 10 may be rotated by way of a gear not shown. Web W may be directly against the surface of the roll shell or there may be a fabric in between, for example, in such a way that the web W is outermost and the wire is against the roll surface. Such an arrangement is advantageous, that the web's W edges extend into the area of the end pieces 20A, 20B and that a holding suction is directed at the web's W edges.

According to the invention, the shell surfaces of end pieces 20A, 20B can be rotated, so that the shell part of the end piece 20A, 20B; its shell surface, will have a different speed when required, and preferably a little higher speed than the speed of the roll shell of the roll 10 associated with the end pieces proper.

In addition, the roll shell of end piece 20A, 20B preferably comprises grooves $U_1$, $U_2$ . . . , preferably peripheral grooves $U_1$, $U_2$ . . . and therein holes in between the grooves $U_1$, $U_2$ . . . and the inside space of the vacuum box, whereby the structure functions like a vacuum roll, which is used to hold the web in contact with the shell surface with the aid of an under-pressure. Thus, the grooves $U_1$, $U_2$ . . . comprise a perforation $a_1$, $a_2$ . . . extending through shell 120*a*, whereby an under-pressure is directed through grooves $U_1$, $U_2$ . . . from the space of the vacuum box into the grooves $U_1$, $U_2$ . . . . Correspondingly, the roll 11 may be a vacuum roll, a suction roll or a leading roll or a drying cylinder. The roll's position is preferably in the drying section. Other positions are also possible. The roll 11 may have a roll shell, which is grooved or perforated and provided with an internal vacuum box, or it may be without any internal vacuum box and may be a roll with a smooth surface.

As is shown in FIG. 3, the device 10 has a rotating or fixed drum 13 in the principal area for suction zones $\mathbf{11}_A$ . . . $\mathbf{11}_D$, which drum 13 is attached to shafts 12A, 12B at either end and bearing-mounted in bearing housings 27. In the arrangement shown, it is possible to arrange suctions of different magnitudes in all zones $\mathbf{11}_A$, $\mathbf{11}_B$, $\mathbf{11}_C$ and $\mathbf{11}_D$ in the cross machine direction, but a more general running model can be, for example, to arrange corresponding suctions in the central zones $\mathbf{11}_A$ and $\mathbf{11}_B$ and to arrange minor suctions in the edge zones $\mathbf{11}_A$ and $\mathbf{11}_B$ or to arrange no suctions at all or to arrange even blowing when needed. Of course, a hold can be arranged also in one chosen zone only. The spreading elements, that is, the holding wheels 20A, 20B are bearing-mounted in bearing housings 27 and they are used to bring about a local force effect through the spreading, when they are turned into an angle in relation to the web's W traveling direction S. The spreading elements 20A, 20B are equipped with turning mechanisms 28A, 28B, which can be used to adjust their opening angle to a desired value in order to bring about a spreading effect in the desired area of the web in the cross machine direction starting from the edges. In addition, the figure shows that the mechanisms 28A, 28B and their inner counter-surfaces 28AA, 28BB on the side of the shaft are formed by curved toroidal surfaces. The concerned curved counter-surfaces are in this application formed as annular pieces with an advantageous use of space as seen in the axial direction. In addition, these inner counter-surfaces 28AA, 28BB are supported separately from the shafts 12A, 12B in the body structures. Correspondingly, guiding surfaces can be formed in bevelled pieces, which have a curved cross-sectional surface and form a periphery and are formed by one or more pieces to form a turning mechanism.

As is shown in FIG. 3, inside the end piece 20A, 20B according to the invention a vacuum box is used, which according to the application example may comprise sectors $Z_1 \ldots Z_2$, shown in FIG. 4, so that a holding suction can be directed in a certain sector and at a certain angle to the web W, such as a paper web or a board web.

FIG. 4 shows a schematic end view of a device according to the invention, from which it can be seen that in the holding wheels, that is, in the spreading elements 20A, 20B, vacuum boxes divided into sectors $Z_1 \ldots Z_8$ (not all labeled in FIG. 4) have been formed, wherein there is an own suction assembly $\mathbf{29}_1 \ldots \mathbf{29}_8$ in each (also, not all labeled in FIG. 4), whereby the web's edge can be held by an under-pressure while bringing about a force effect on the web in the cross machine direction. Differing from the grooves in a peripheral direction shown in FIG. 2, the grooves in these sectored $Z_1 \ldots Z_8$ end pieces 20A, 20B are in the direction of shaft 12A, 12B or at an angle in relation to the shaft, so that the suctions of vacuum boxes of adjacent sectors $Z_1 \ldots Z_8$ will not affect in the peripheral direction in the area of adjacent sectors through the grooves. The grooves in the peripheral direction shown in FIG. 2 are suitable, for example, in such an application where there are no separate suction sectors. Directing the holding suction from an end piece to the web can also be used besides the grooves or independently by applying solutions known in the state of the art from the vacuum roll's boring, that is, by providing the end piece with bored holes, which do not necessarily open into grooves in the surface, but which may be, for example, countersunk. When applying crosswise grooves or especially suction holes, a better suction efficiency is also achieved, as the suction will not escape along the grooves.

In an embodiment of the invention shown in FIGS. 2-4, spreading elements 20A, 20B are used to direct a force effect of the desired magnitude in the cross machine direction starting from the web's W edges to the desired crosswise position of the web, whereby the web's characteristics can be modified. In between the edge parts WS of the web W there may remain an area, to which no force effects are directed. The spreading elements are most suitably mounted on shafts 12A, 12B for independent use by drives 25A, 25B, whereby the force effect is controlled by the suction effect area, by the time of effect, by the toe-out and with the aid of the zoned suction/blowing roll 10, to which the force effect is directed all the way until the roll's suction zone. Holding wheels 20A, 20B may also be pivots 28A, 28B, which are pivoted without a drive with a transmission on shaft 12A, 12B. When desired, the vacuum roll's 10 suction zones 13 can be equipped with a blowing option in order to control the force effects. Holding of the web W in the area of spreading elements 20A, 20B is implemented through friction forces. It is possible to adjust the toe-out, that is, the opening angle of the spreading elements, in both directions at the same time or separately to the desired degree, and an implementation is possible, which is mechanical, hydraulic, pneumatic or an electric actuator.

Figure 5:
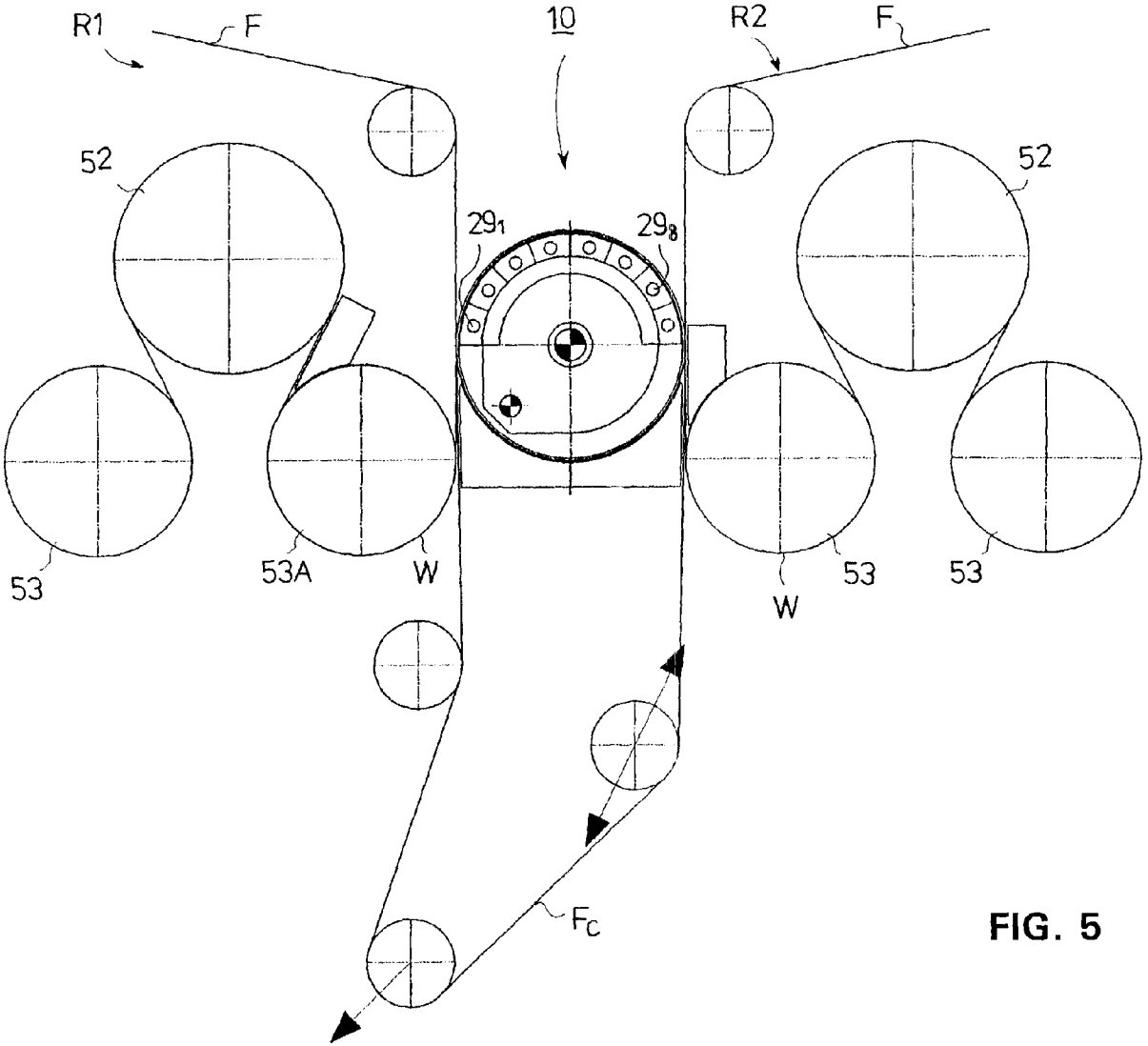
FIG. 5 shows schematically a roll according to the invention adapted in connection with a drying group applying single-wire transfer.

In the application shown in FIG. 5, the device 10 according to the invention is located in between drying banks R1, R2 applying normal single-wire transfers. Drying cylinders 52 are located in an upper row and pivoting cylinders 53 in a lower row, and the drying wire is indicated by reference F. In between the two banks R1, R2 the device 10 according to the invention is located, which is equipped with a fabric wrap $F_C$ of its own, which supports web W being led through the device 10 in such a way that with the turning spreading elements 20A, 20B the desired spreading effect is brought about in the web W in the cross machine direction starting from the edges. Spreading is more efficient, if the fabric $F_C$ does not extend into the area of the spreading elements 20A, 20B. The thickness of the fabric can hereby be compensated for by a difference in diameters between the central part and the spreading elements. As web W is arriving from pivoting cylinder 53A upwards, the suction zones $\mathbf{11}_A \ldots \mathbf{11}_D$ (shown in FIG. 3) in the central part of device 10 and the first suction sector $Z_1$ of the spreading elements 20A, 20B will move the web from fabric F to fabric $F_C$ and to the holding wheels 20A, 20B. Correspondingly, the transfer-suction box D will move the web from the device 10 to bank $R_2$.

FIGS. 6A-6I show some applications for locating the device in the drying section of a papermaking or a board-making machine. In FIGS. 6A-6I the same reference marks are used for similar parts.

In FIGS. 6A-6B, the device according to the invention is placed in connection with a single-wire transfer.

In FIG. 6A, single-wire transfer is applied within a bank, whereby the drying wire F is conducted from a pivoting cylinder or roll 53 through leading rolls 31 to the following pivoting cylinder or roll 53, and in place of the drying cylinder 52 normally located in this position the device 10 according to the invention is placed, through which the web W is conducted as a supported transfer, supported by fabric $F_C$ and further to the same continuing bank by the transfer-suction box 32.

In FIG. 6B, the device according to the invention is located in between two drying banks applying single-wire transfer. The web is led from the last pivoting cylinder 53 of the preceding bank to the device 10 according to the invention, and from the device 10 further to the first pivoting cylinder 53 of the following bank.

In FIG. 6C, the device according to the invention is located in between banks of drying cylinders, one of which applies single-wire transfer and the other applies two-wire transfer, where the web is led from the last pivoting cylinder 53 of the drying bank applying single-wire transfer to the device 10 according to the invention and further to a pivoting cylinder 54 arranged in connection with the top wire of a drying bank applying two-wire transfer.

In FIG. 6D, the device 10 according to the invention is also located in between a drying bank applying single-wire transfer and a drying bank applying two-wire transfer, where the web is led from the last pivoting cylinder 53 of the drying bank applying single-wire transfer through the device according to the invention to cylinder 54 in connection with the top wire FY of the drying bank applying two-wire transfer.

In FIG. 6E, the device 10 according to the invention is located inside a drying bank applying two-wire transfer and it is used to replace one of the drying cylinders in the upper row, whereby the drying wire FY is led to cylinder 54 by way of leading rolls 31 and the web is led through the device 10 according to the invention to cylinder 54. In this application, a fabric sleeve press $F_S$, for example, can be used instead of the fabric $F_C$.

Figure 6H:
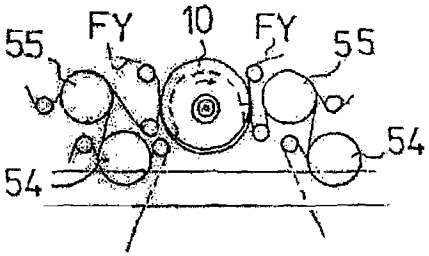
Figure 6G:
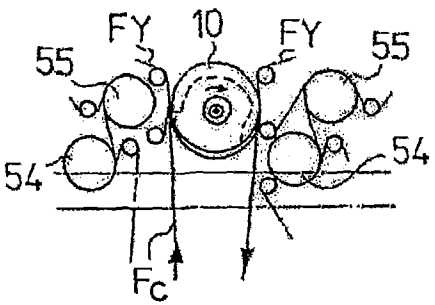
Figure 6I:
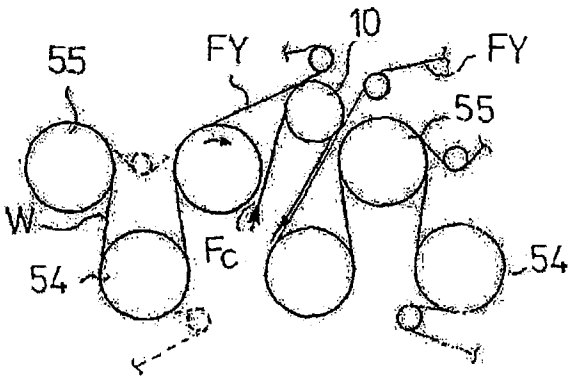
Figure 6F:
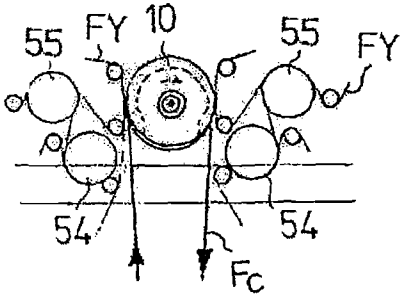

In FIG. 6F, the device 10 according to the invention is located in between two drying banks applying two-wire transfer, where the web is led from the top wire FY of the preceding drying bank to the device 10 according to the invention and further to be in connection with the top wire FY of the following drying bank.

In FIG. 6G, the device according to the invention is also located in between two drying banks applying two-wire transfer, where the web W is led from the top wire FY of the preceding drying bank to the top wire FY of the following bank and further to the cylinder 54.

FIG. 6H shows an application, where the spreading roll's 10 separate wire circulation is replaced by a fabric sleeve press as wide as the roll's central part in such a way that it does not extend into the area of the spreading elements 20A, 20B. Such a space-saving solution simplifying structures can be joined to any application shown in FIGS. 6A-6I when desired.

FIG. 6H also shows a device according to the invention located in between drying banks applying two-wire transfer, which device corresponds with the application of the invention presented in FIGS. 6F and 6G. In addition, the solutions shown in FIGS. 6F, 6G, 6H can be applied similarly in connection with a bottom wire as a horizontal mirror image.

In FIG. 6I, the device according to the invention is located in between drying banks applying two-wire transfer, and the device is located in an upper position of the drying cylinders 55 in the upper row, whereby the web is conducted on the top wires to the device according to the invention and away from the device according to the invention.

According to FIG. 7, a management and control system 80 is arranged in connection with a papermaking machine PK to take into account the provision of a force effect in the web's edge area. With the system 80 improved spreading control and tension/length control are brought about. The roll presented above and shown in FIGS. 2-4 is located in the drying section, for example, in positions 85A, 85B, and it is controlled based on measurement results and through edge control of a rheology model and through roll control. Shown in FIG. 7 are a steam-box 81, moisture measuring points 82A, 82B and a web-tension measuring point 84. When desired, the results of measurements are processed in an optimizing unit 87 and the control information 88A on tension, modulus of elasticity and length is relayed to the roll's 85A, 85B control unit, while the control information 88B on moisture is relayed to the control 83 of on-blowing drying 83 and to the steam-box control 81, while the control information 88C on the basis weight is relayed to the headbox control 86.

According to FIG. 8, on the Y axis are marked the MD/CD or tensile strength ratio in the machine direction/cross machine direction and the β formation by curve β and the tensile strength ratio by curve α. On the horizontal axis, the jet-wire ratio, that is the J/W ratio is shown. As emerges from FIG. 8, when the roll according to the invention is mounted in position 1, the strength will grow in the cross machine direction, whereby the machine direction/cross machine direction ratio will decline. Since the CD strength is higher, the jet-wire ratio can be increased, whereby the same tensile strength ratio is achieved as earlier at point A, but the strength in the machine direction and the runnability have improved due to greater orientation and the formation has improved (decreased). On the X axis at point $X_1$ the initial situation is marked, and with a certain jet-wire ratio the tensile strength ratio A and the formation B are obtained. When the roll according to the invention is mounted, the final situation is obtained at point $X_2$, whereby with the same machine direction/cross machine direction tensile strength ratio A, a higher strength in the machine direction is obtained, that is, better runnability in paper-making machines, whereby the runnability is also better in a printing press and the quality is better, that is, β formation at point B'. The invention makes possible control ranges for draws, jet-wire ratios, etc., which become larger allowing a more flexible choice of characteristics and raw materials for the final product.

Figure 9A:
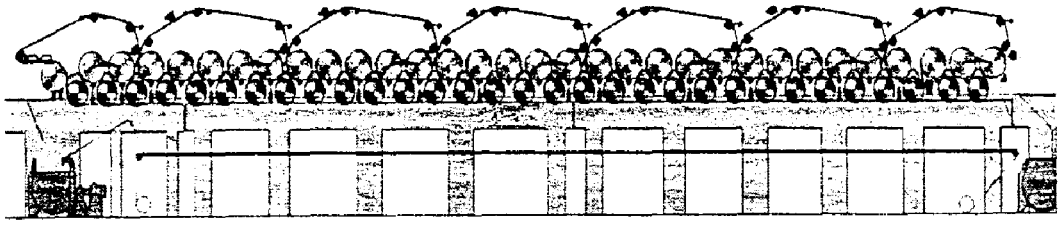
FIGS. 9A and 9B show a schematic example of a shrinkage profile (FIG. 9B) after a state-of-the-art drying section (FIG. 9A).
Figure 9B:
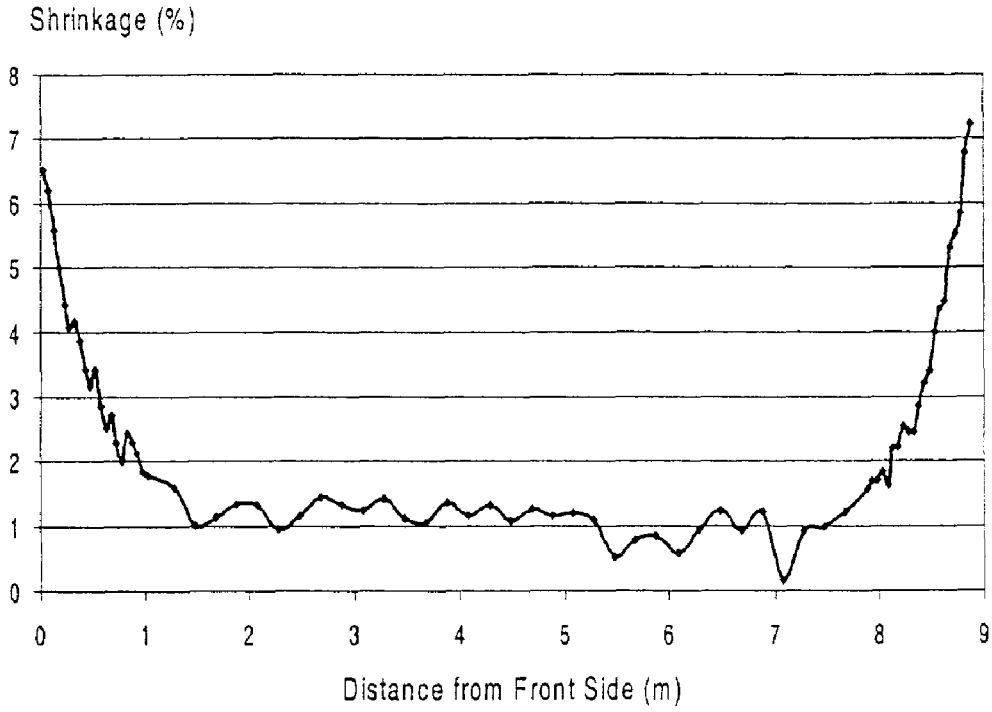

In the shrinkage profile example shown in FIGS. 9A-9B, a non-linear shrinkage profile FIG. 9B is shown, which has been noticed after the drying section according to FIG. 9A applying single-wire transfer. In FIG. 9B, the shrinkage is on the vertical axis and the distance from the forward end of the web is on the horizontal axis. As can be seen in FIG. 9B, shrinkage is stronger in the web's edge areas. It is most advantageous for the papermaking and for further processing, that the shrinkage profile would be as uniform as possible, that is, the shrinkage profile is almost straight and in the same place on the vertical axis. It is in fact an objective of the invention to work on the shrinkage profile to achieve one of the desired kind. According to the invention, the shrinkage profile is usually corrected most advantageously in the early part of the drying section, because shrinkage takes place in the drying section and in accordance with an advantageous application of the invention, the web is spread correspondingly from the shrinking areas in the area of the drying section.

Figure 10:
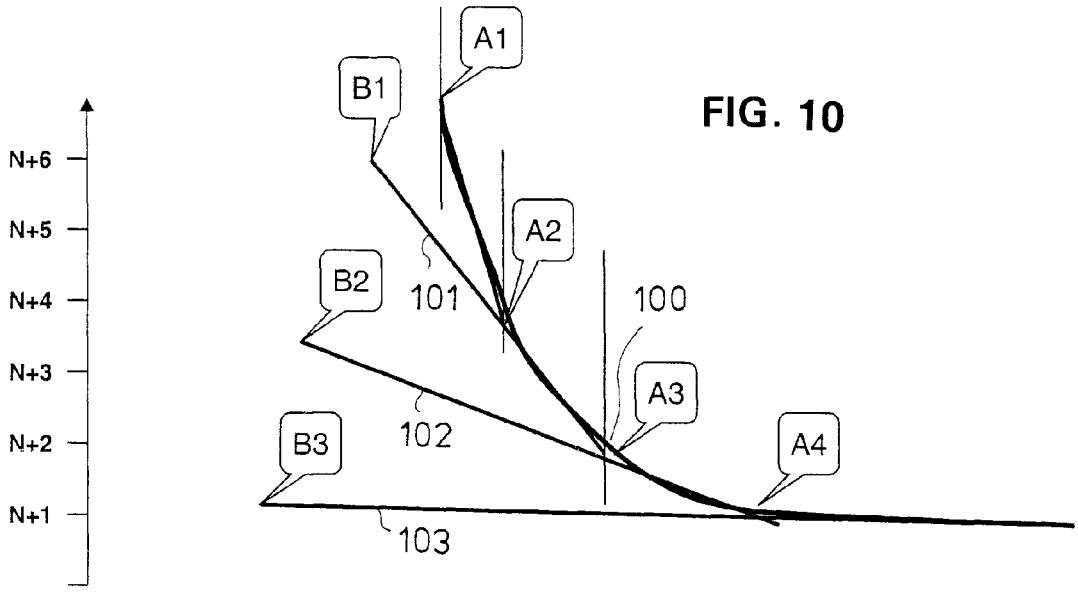
FIG. 10 shows schematically the approach according to the invention for eliminating shrinkage.

FIG. 10 shows a descriptor 100 of the traditional shrinkage profile and the elimination of shrinkage is followed as regards points A1 A2, A3, A4. At these points, the shrinkage (N+y) % is a function of the place X (that is, a function of the place in the CD direction). According to the invention, a stretching in steps is carried out, for example, in the following manner:

Step 1: The web is stretched holding on to places A1 and A2, in such a way that A2 remains in its place and A1 moves outwards in such a way that the final shrinkage changes into form B1-A2, descriptor 101.

Step 2: The web is stretched holding on to places B1 and A3 in such a way that A3 remains in place and B1 moves outwards so that the final shrinkage changes into form B2-A3, descriptor 102.

Step 3: The web is stretched holding onto places B2 and A4 in such a way that A4 remains in place and B2 moves outwards so that the final shrinkage changes into form B3-A4, descriptor 103.

FIG. 10 shows an example of how the stretching can be done in accordance with the invention. The order and number of steps as well as the location of centrally located places, except the edge, can be chosen freely. It should also be noted that also stretching from one place only may be sufficient in some cases.

Figure 11:
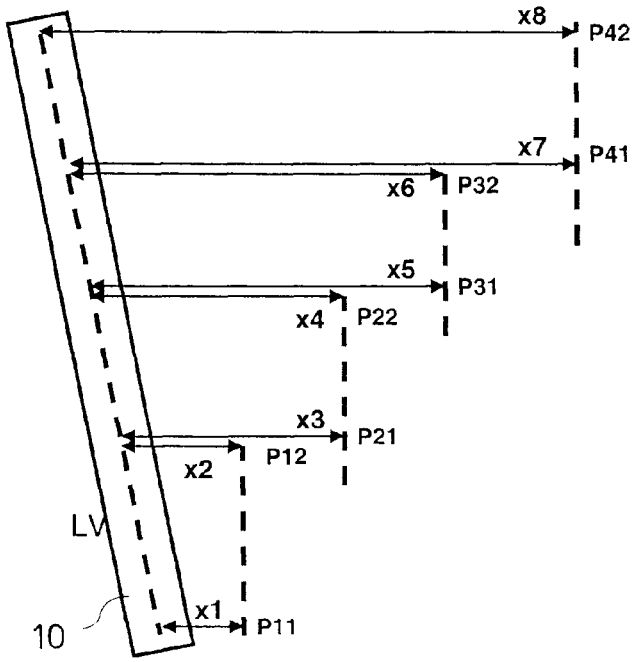
FIG. 11 shows schematically elimination of shrinkage according to the invention.

FIG. 11 shows correspondingly the web's passage over the device 10 used in connection with the invention. The web's edge is attached to spreading roll 10 at place P11, whereby the spreading is directed to the web's width x1. As the web is traveling to place P12, said width x1 has changed to width x2 thanks to the spreading. This corresponds to the first step shown in FIG. 8, that is, the A1-A2 conversion to B1-A2. In the following step, the hold P12 is released, whereby the hold is directed to place P21 and the part to be spread is now x3, which broadens correspondingly to x4 as the web has proceeded to place P22. This can be repeated the desired number of times, such as, for example, two more times in the figure (x5, x6, P31, P32, x7, x8, P41, P42). In FIG. 11, the spreading has proceeded in a sequence starting from the web's edge. According to the invention, this can be chosen freely in order to bring about the desired structure of the paper.

FIGS. 10 and 11 show possibilities of spreading in steps with one device only, but more spreading rolls may be used as well and the steps may also be divided between them. Hereby the progress of drying of the web can be utilized in choosing the place of location for the devices, because the edges of the paper will usually dry a little earlier, so the latter spreading roll can be used more efficiently to straighten any shrinkage farther away from the edge.

Figure 12:
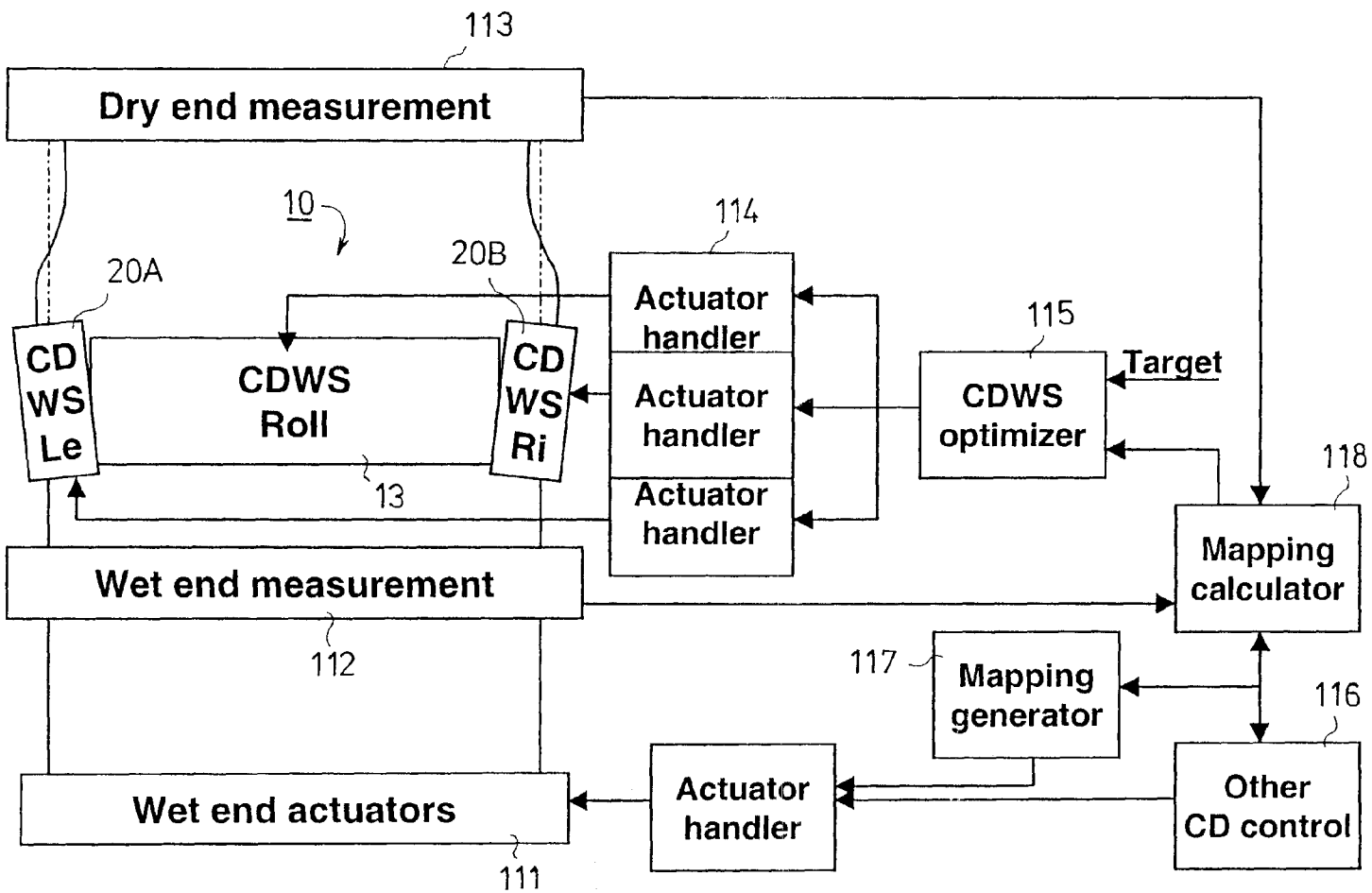
FIG. 12 shows a schematic presentation of the web's progress from the wet end to the dry end in papermaking and devices relating to web control according to an application of the invention.

FIG. 12 shows the web's progress from the wet end to the dry end and the devices belonging to the web management.

Wet End Actuators 111 are actuators for management of the cross-sectional profile, for example, a system used to control the dilution water of a dilution headbox, wherein the valves to be controlled are located with a typical interval of 60 mm and the devices bring about a change in the web like a Gaussian curve, in such a way that the effect of the concerned one actuator extends almost 100 mm on both sides of the central point. Using the actuators a certain characteristic of the web is controlled, such as with the aid of dilution valves of the dilution headbox the cross-sectional profile of the basis weight is controlled in a manner known as such. It should be noted especially here that the actuator may be used to form an excitation signal, which assists in the control of the widening and shrinking of the web. The use of an excitation signal is known as such, as is detection of the change it causes and determination of the shrinkage profile and directing of actuator responses to the measurement profile. Typically, widening and/or shrinking of the web before the Wet end measurement 112 equipment take place to a minor degree. However, a width known as such can be removed from the web, because the quality characteristics of the edge are not sufficient for further processing.

The Wet End Measurement 112 can be before the spreading roll 10, for example, equipment known as such and located in the early part of the drying section for measuring the cross-sectional profile. Here the web is detected before spreading. The whole profile may be measured and this information used, or the places of the trouble/excitation signal edges may be measured, whereby the web's correct width before spreading is found out. The web will widen/shrink to a minor degree only before the spreading equipment 10.

CDWS (Cross Direction Wet Straining) Roll 13, that is, with the aid of the spreading equipment's 10 holding device, that is, the drum 13 the web is held in the manner described in the invention at least in the middle, but according to the invention also elsewhere, either all the time or in the manner determined by the control (CDWS Optimizer 115).

CDWSLe (Cross Direction Wet Straining Left) 20A is a device widening the spreading equipment 10 to the left and holding the web at its left edge in accordance with the invention. The length of widening is determined either manually by setting or by the CDWS optimizer 115. Likewise, the spreading angle (toe-out) is determined and controlled either manually or by the CDWS optimizer 115.

Correspondingly, CDWSRi (Cross Direction Wet Straining Right) 20B is a device widening the spreading equipment 10 to the right and its functioning corresponds to the functioning of the device 20A widening to the left, as was described above.

Typically, the web shrinks before the Dry end measurement equipment. Spreading is used as an attempt to eliminate the effect of shrinkage, that is, the objective is to make the shrinkage profile straight or at least into a shape that has been found good.

The Dry end measurement 113 measures the paper characteristics, such as the basis weight, moisture, etc. In addition, the measuring device 113 measures the web width, and it also measures the effect of the excitation signal formed by the Wet end actuator equipment 111.

There are several Actuator handler 114 devices and they control the actual equipment 10 to be handled in a manner determined by a control system of an upper level. Actuator handler 114 may also be a function built into the concerned device 10, whereby it is invisible in the illustration presented here. In addition, there is a headbox control device at the wet end, an actuator handler 114.

Other CD Control 116 is a control device for controlling the cross-sectional profile of the basis weight, which is done based on the post-drying basis weight measurement by controlling either the lip profile of the headbox (opening of the lip in the CD direction) or the dilution ratio and this way by controlling the dilution valves. As is known, this may also be done based on the basis weight measurement before the drying section, or with the aid of both in a manner known as such. Other CD control 116 may also mean a control of moisture or tension or a combination of these in a manner known as such.

The Mapping generator 117 software produces an excitation signal needed for the determination of the shrinkage in a manner known as such.

The Mapping calculator 118 software calculates the web's established shrinkage profile by utilizing the Wet end actuator's 111 excitation signal, measurement information produced by the Wet end measurement equipment 112, at least width information, and width information of the dry end measurement and the effect of the excitation signal in the measurement profile.

In this manner a directed measurement profile is formed (from which the effect of spreading and shrinking has been eliminated) for a control controlling the wet end actuator (Other CD control). This control should be made as quick as possible. Another central signal is calculation of the shrinkage profile. The shrinkage profile contains both the effect of the spreading equipment and the effect of the drying shrinkage.

The CDWS optimizer 115 is a central core in the arrangement according to the invention. Although this part is formed by pieces known as such, the combination forms an inventive whole. The optimizing device 115 uses traditional feedback control methods or cost-function-based optimizations or rules of deduction/calculations based on fuzzy control or control rules based on neuro-network models, which methods are known as such. Correction of the CD profile, typically spreading, is done either once optimizing or sequentially, as is shown in FIGS. 8 and 9. The physical models of the paper's structure and behavior are known or they are simplified models, which can be determined by process tests. The mathematics needed is known as such. Typically, the control is made slower than the CD control, but the invention also allows a quick control.

FIG. 13A is a longitudinal cross-sectional view of a roll's 10 end pieces 20A, 20B according to the invention as shown in FIG. 2. The end pieces are located at each end of the roll 10. The end piece 20A, 20B comprises a pivot 213, such as a pivot bearing, supporting the end piece 20A, 20B, so that this can be tilted around shaft 2Z. The tilting end piece 20A, 20B comprises a body part 215, to which a motor 25A;25B is connected. The motor $M_1$ comprises an output shaft 216, which is mounted with bearings 221$a_1$, 221$a_2$ to the body 215 and to which shaft a gearwheel 217 is connected, which drives and rotates a gearwheel 218, which is a peripheral gearwheel and which is connected to edge part 219 and thus to flange 220. In the area between the edge part 219 of flange part 220 and the pivot 213 there is a bearing 222, with the aid of which the flange part 220 of end piece 20A, 20B and also the shell part connected thereto are adapted for rotation. The bearing 222 can be a ball bearing.

Actuator 223 is used to carry out tilting of end piece 20A, 20B. Actuator 223 may be a cylinder actuator, an electric motor, a pneumatic actuator, a hydraulic actuator, etc. It comprises an arm t, which is pivoted at its ends by pivots $e_1$ and $e_2$. By moving the arm t with actuator 223 different tilting angles are obtained for the end piece 20A, 20B.

Thus, with the aid of actuator 223 the end piece 20A, 20B and its shell part can be tilted and with the aid of motor 25A;25B, such as an electric motor, the shell part is rotated as desired, for example, at a somewhat higher speed than the speed at which the shell part of the roll 10 connected to end pieces 20A, 20B is rotated. The actuator 223, for example, a cylinder, may connect with a pivot mechanism, as the one shown, for example, in FIGS. 14A and 14B. With the aid of actuator 223 the body part 215 and the structures joined to it are made to slide along a curved path (arrow $L_1$), whereas the bearing part 224 of pivot 213 and the body 215 connected thereto can be made to slide in such a way that its curved surface 224*a* will slide along the curved counter-surface 225*a* of the counter-bearing part 225 in the manner indicated by the arrow $L_1$. The center of curvature is on the Z axis at point $E_1$. Also as shown in FIG. 13A, there is another curved guiding surface 225', 224' in pivot 213. Shaft C has an axis x. As can be seen in the figure, under shaft C, its center of curvature is also on the axis 2Z and at point $E_1$. The axis 2Z is perpendicular in relation to the longitudinal cross-sectional plane of the device shown in FIG. 13A and it extends through turning point $E_1$. The body's 215 structural parts 218, 219, 220, which can be rotated by a motor, are shown as section lines in different directions than the other parts of the end piece's 20A, 20B body 215. However, part 218 is not indicated by section lines. In connection with the shell part the structure comprises a vacuum box, whereby the holding suction to the web W is directed from the vacuum box through holes $a_1$, $a_2$ . . . extending through the shell part. In this embodiment, the vacuum box extends over a part of the peripheral distance.

Figure 13B:
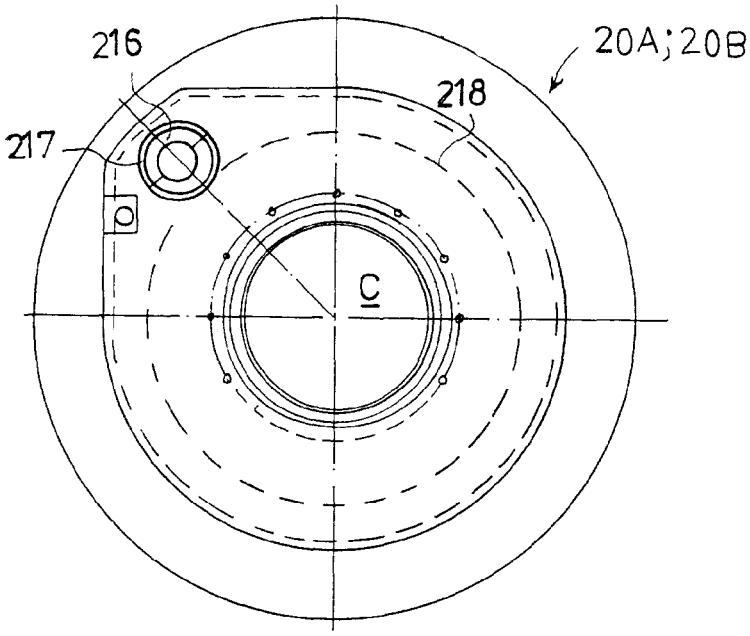
FIG. 13B is a principal view of a structure from the direction of arrow K1 in FIG. 13A.

FIG. 13B shows the equipment from direction $K_1$ of FIG. 13A.

FIG. 14A shows a position of the end piece, where its shell part is located against the shell part of roll 10. FIG. 14B shows tilting/turning carried out by an actuator 223, where the end piece has been moved over a distance S of 160-200 mm from its one edge $E_2$ to be free of the roll shell, whereby the turning takes place around turning point $E_1$ and shaft 2Z. The tilting angle of the turning action is approximately 5° in FIG. 14B.

The pivot 213 supporting the end piece 212 for a tilting movement comprises at least bearing pieces 224, 225. These comprise curved slide surfaces 224*a*, 225*a*, whereby the turning point of the tilting action is the edge $E_1$ of the rotated shell part of end piece 20A, 20B. The end piece can hereby be tilted through a certain angle of deflection in relation to the end face of roll 10 and the shell part's edge $E_2$ opposite to the turning point is separated from the roll's 10 roll shell. With the turning/tilting arrangement a desired direction of rotation is thus obtained for the shell part of end piece 20A, 20B and it is deflected from the traveling direction of the paper web, whereby spreading of the paper web W becomes possible and web W is subjected to a focused force F in a cross machine direction in relation to the machine direction. In this embodiment, the vacuum box extends over the entire distance of the shell part's periphery. Through it and further through the holes $a_1$, $a_2$ . . . passing through the shell surface of the shell part a holding suction is directed at the web W. Thus, by tilting the end piece 20A, 20B and by rotating the shell part a force F can be directed to the edge area of web W. Force F is crosswise in relation to the traveling direction $S_1$ of web W and thus in relation to the machine direction.

Pivot 213 is formed by at least one piece and in relation to the direction of the gravitational field by at least one upper piece, which comprises a curved guiding surface 225*a* and in the bearing part 224 connected to the tilting end piece 20A, 20B a curved surface 224*a* of a corresponding shape and sliding along the curved surface 225*a*. In the embodiment shown in FIGS. 14A and 14B, there is a separate arm t, to which an actuator 223 is connected, whereby arm t is used to exert a force to the tilting end piece 20A, 20B and to the bearing piece 224 located in its body 215 and it is made to slide along the curved surface 225*a* of pivot 213 (arrow $L_1$), whereby a desired turning/tilting angle $\alpha$ is obtained for the end piece 20A, 20B and the shell. The center of curvature is on the axis 2Z at point $E_1$ (the curved motion is also indicated by an arrow $L_1$). Also as shown in FIG. 13A, there is another curved guiding surface 225', 224' in bearing 213, as shown in FIG. 13A below the shaft C. Its center of curvature is also on axis 2Z and at point $E_1$. Here the curved guiding surfaces 224*a*, 225*a*, 224', 225' are formed as seen from the direction of shaft C by a bearing part 224 of a circular shape and by its mating surface 225, which is an advantageous application in terms of space use. Arm t is pivoted by pivots $e_1$ and $e_2$ at its ends. An actuator 223 is connected at its body to an external supporting body R. Part 225 is supported in a supporting body $R_U$. Shaft C is placed to extend freely through a through-opening J of part 225. The supporting body $R_U$ also comprises rotation bearings G for shaft C.

The center of curvature $E_1$ of the guiding surfaces 224*a*, 225*a* of pivot 213 is in the edge of the shell part of end piece 20A, 20B. The pivot of end piece 20A, 20B functions as a pivot bearing for end piece 20A, 20B and preferably comprises, besides the first guiding surfaces 224*a*, 225*a*, on the side opposite to pivot 213 second guiding surfaces 224', 225', and the upper and lower guiding surfaces have their center of curvature on axis 2Z, which axis 2Z as presented in the figure is perpendicular against the plane of the figure side. The center of curvature $E_1$ of the guiding surfaces 224*a*, 225*a* and the center of curvature of the second guiding surfaces 224', 225' is the center of curvature $E_1$ of the end piece 20A, 20B.

FIG. 15A shows a view in principle of a vacuum box according to the invention connected to end piece 20A, 20B, which vacuum box is divided into sectors 130*a*$_1$, 130*a*$_2$, 130*a*$_3$ . . . In between the sectors 130*a*$_1$, 130*a*$_2$ . . . there are partitions $n_1$, $n_2$, $n_3$ . . . In this embodiment, the vacuum box has an annular peripheral structure. Such an embodiment is also possible, where there is only one sector, which extends in a ring-like manner along the periphery of the whole structure. It is possible that there are sectors 130*a*$_1$, 130*a*$_2$ only at certain places of the periphery in a certain angular sector.

FIG. 15B is a sectional view along line II-II of FIG. 15A. The vacuum box is joined to the body 215 of end piece 20A, 20B and it comprises edge seals $j_1$, $j_2$, which are used to keep tight the internal space D of the vacuum box. Through hoses 200 an under-pressure is directed into vacuum space D and further through a perforation $a_1$, $a_2$ . . . into grooves $U_1$, $U_2$ . . . and further to web W. The direction of suction through the hose 200 is indicated by an arrow $L_2$.

In the embodiment shown in FIGS. 15A and 15B, the end piece 20A, 20B comprises a vacuum box comprising separate sectors 130*a*$_1$, 130*a*$_2$ . . . , into which vacuum box an under-pressure is introduced through hoses 200. Hereby the end piece 20A, 20B comprises in its shell part a perforation $a_1$, $a_2$ . . . , whose holes open into a free internal vacuum space D in the vacuum box. From the vacuum space D a connection exists through holes $a_1$, $a_2$ . . . into grooves $U_1$, $U_2$ . . . located in the surface of shell part 120*a* in order to direct a holding suction to the web W, such as a paper web or a board web. Thus, the vacuum box comprises edge seals $J_1$, $j_2$, which seal the internal space D of the vacuum box against the inside surface of the rotated shell. The vacuum box is attached to the body part 215 of the end piece 20A, 20B.

FIG. 16 illustrates the operating principle of the device. When rotating the end piece 20A, 20B at its shell part, preferably at a somewhat higher speed than the actual roll's 10 roll shell, and by turning the end piece 20A, 20B by the actuator 223 and by providing a holding suction through holes $a_1$, $a_2$ . . . from space D to the edges of web W a draw F is brought about in the web in a side direction. Hereby a spreading force is brought about in the web and spreading of the web W to the side. The web's W traveling direction in the machine direction is indicated by an arrow $S_1$. The direction of rotation of the shell part of end piece 20A, 20B is indicated by an arrow $S_2$, when tilting of the end piece 20A, 20B and its shell part has been performed in relation to point $E_1$.

FIGS. 17A and 17B show an embodiment, where grooves $U_1$ and $U_2$ . . . are straight, ending grooves $U_1$, $U_2$ . . . Borings $a_1$, $a_2$ . . . open into the grooves $U_1$, $U_2$ . . . , which in this embodiment have their longitudinal axis at right angles, that is, crosswise in relation to the machine direction and in relation to the direction of rotation $S_2$ of the shell part of the end piece. Said grooves $U_1$, $U_2$ . . . are ending grooves and they are placed in the periphery of the shell part at a distance from each other. The vacuum box is divided into sectors 130*a*$_1$, 130*a*$_2$, that is, into departments. Hereby the grooves $U_1$, $U_2$ . . . $U_N$ of the end piece 20A, 20B are in the direction of shaft C or at an angle in relation to shaft C in such a way that suctions of departments 130*a*$_1$, 130*a*$_2$ . . . 130*a*$_n$ of adjacent sectors do not through the grooves affect in the area of sectors which are adjacent in the peripheral direction and do thus not interfere with the suction of the adjacent sector nor with the directing of a holding force to web W.

FIG. 17C shows an embodiment, where a boring $a_1$, $a_2$ . . . opens into a circular enlargement $U_1$, $U_2$ . . . , which is a conical countersinking in the surface of the shell part.

FIG. 18 shows a shape of the curved surfaces 224*a*, 225*a* and also of the surfaces 224', 225'. The surfaces 224*a*, 225*a*; 224', 225' are cylinder surfaces. The presentation in FIG. 18 is illustrative and it shows the curved surface 224*a* joining part 224 as separate from the counter-surface 225*a* joining part 225.

FIG. 19 shows an embodiment of the bearing parts 224, 225 of the pivot bearing 213, where the center of curvature of the surfaces 225*a* and 225*b* is located on axis 2Z. In the longitudinal sectional planes of the device, which sectional view is shown, for example, in FIGS. 13A, 14A and 14B, the surfaces 224*a*, 225*a* have their center of curvature on axis 2Z and in the figure at point $E_1$. In planes perpendicular to said planes, the shape of the guiding surfaces 224*a*, 225*a* of parts 224, 225, that is, the shape of the bearing profile, is, for example, such a shape as is shown in FIG. 19 by dashed lines. The cross-sectional shape may be circular or some other shape.

In the foregoing, the invention has been described by referring only to some advantageous application examples of the invention, but the intention is not in any way to limit the invention narrowly to the details of these examples.

It is understood that the invention is not limited to the particular construction and arrangement of parts herein illustrated and described, but embraces all such modified forms thereof as come within the scope of the following claims.

The invention claimed is:

1. A method of treating a web having a width in a crossmachine direction, in a papermaking machine drying line employed after a wire section, the method comprising the steps of:

dewatering a web supported at times by at least one of a fabric or drying wire, and within the dewatering step increasing the crossmachine direction width of the web by applying a stress of a selected magnitude to an edge of the web to cause an increase in crossmachine direction width in a portion of the web;

wherein the stress is applied between the edge of the web and a selected position on the web spaced toward a centerline of the web, which selected position is held against stress directed toward the edge of the web; and wherein the web travels over a first rotating roll forming a whole, the first rotating roll having an axis of rotation wherein the whole roll rotates about the axis of rotation, and the stress is applied to the web by holding the edge of the web to a first rotating shell mounted to a first end of the first rotating roll, but having an axis of rotation which is tilted with respect to the axis of rotation of the first rotating roll so that the web is strained in the crossmachine direction between the edge of the web and the selected position on the web spaced toward the centerline of the web by action of the first rotating shell;

wherein the web is strained in a plurality of steps comprising:

after first straining the web between the edge of the web and the selected position;

then straining the web a second time between the edge of the web and a second selected position on the web spaced further toward the centerline;

wherein the web is strained the second time while traveling over a second rotating roll forming a whole, the second rotating roll having an axis of rotation wherein the whole role rotates about the axis of rotation, and the stress is applied to the web by holding the edge of the web to a further first rotating shell mounted to a first end of the second rotating roll, but having an axis of rotation which is tilted with respect to the axis of rotation of the second rotating roll so that the web is strained, by action of the further first rotating shell, in the crossmachine direction between the edge of the web and the second selected position on the web spaced further toward the centerline of the web than the selected position; and wherein the second selected position is held against stress directed toward the edge of the web by applying suction to the web with a suction zone on the second rotating roll.

2. The method of claim 1 wherein the selected position is held against stress directed toward the edge of the web by applying suction to the web with a first suction zone of a plurality of separate suction zones, arrayed one after the other in the crossmachine direction.

3. The method of claim 1 wherein the first roll and the second roll each have a plurality of suction zones and at least one of the plurality of suction zones is equipped with a blowing option, the method further comprising:

blowing in at least one of the plurality of suction zones to control the straining of the web.

4. The method of claim 1, wherein the step of increasing the crossmachine direction width is accomplished in 0.1-5 seconds.

5. The method of claim 4 wherein the step of increasing the crossmachine direction width of the web is accomplished while the web moves about 5-270° about the first rotating roll at a machine speed of 300-1800 m/min.

6. The method of claim 1 wherein the crossmachine direction width of the web is increased by 0.5-5%.

7. The method of claim 1, further comprising changing a rigidity ratio of the web as a result of the web increasing in crossmachine direction width.

8. The method of claim 1 wherein the step of increasing the crossmachine direction width of the web is applied when the web has a dry-matter content above 10%.

9. The method of claim 1 wherein the step of increasing the crossmachine direction width of the web is applied when the web has a dry-matter content between 45-75%.

10. The method of claim 1 wherein the step of increasing the crossmachine direction width of the web is applied when the web has a dry-matter content between 30-80%.

11. The method of claim 1 wherein the device applying the stress is controlled automatically based on results of measurements of the web provided by the papermaking machine.

12. The method of claim 11 wherein the straining of the web is controlled based on the output of measuring devices positioned at a wet end of the papermaking machine before the first rotating shell mounted to a first end of the rotating roll.

13. The method of claim 1 wherein the web is supported by a fabric or drying wire on the first rotating roll.

14. The method of claim 1 wherein the first rotating roll is rotated at a first speed, and wherein the first rotating shell is rotated at a higher speed than the first speed.

15. The method of claim 13 wherein the web is not supported by the fabric or drying wire on the first rotating shell.

16. A method of cross machine direction wet straining of a web having a first edge, a second edge, and a center line therebetween, the method comprising the steps of:

dewatering the web to a dry matter content greater than 10% and less than or equal to 80% while supported by a fabric or drying wire;

a first step of holding a portion of the web between the first edge and the centerline to a rotating roll forming a whole, the rotating roll having an axis of rotation wherein the whole roll rotates about the axis of rotation, and applying a stress to the web by holding the first edge of the web to a first rotating shell mounted to a first end of the rotating roll, but having an axis of rotation which is tilted with respect to the axis of rotation of the rotating roll, such that the portion of the web held to the rotating roll and the edge of the web held to the rotating shell are drawn apart, straining the web between the first edge of the web and the held portion of the web; and wherein the portion is held against stress directed toward the edge of the web by applying suction to the web with a first suction zone of a plurality of separate suction zones, arrayed one after the other in the cross machine direction.

17. The method of claim 16, further comprising a second step of holding a second portion of the web between the second edge and the centerline to the rotating roll, and applying a stress to the web by holding the second edge of the web to a second rotating shell mounted to a second end of the rotating roll, but having an axis of rotation which is tilted with respect to the axis of rotation of the rotating roll, such that the second portion of the web held to the rotating roll and the second edge of the web held to the rotating shell are drawn apart, straining the web between the second edge of the web and the second portion of the web.

18. The method of claim 17, wherein the web in the absence of cross machine direction wet straining has a shrinkage graph in the shape of a bathtub with more shrinkage on the edges and less shrinkage between the edges; and wherein the first step and the second step are repeated a plurality of times, each subsequent time the portion and the second portion held are located closer to the centerline.

19. The method of claim 18 wherein the first step and the second step are controlled such that the shrinkage of the web in the cross machine direction is substantially uniform.

20. An apparatus in a paper or board machine line positioned after a wire section, the apparatus comprising:

a web having a first edge and a second edge and a centerline between the first edge and the second edge, the web wrapped about a selected angle of a rotating roll forming a whole and mounted for rotation about an axis wherein the entire roll rotates about the axis of rotation, the rotating roll having a first end part, and a second end part;

a first rotating shell mounted to a first end part of the rotating roll, but having an axis of rotation which is tilted with respect to the axis of rotation of the rotating roll, the first rotating shell arranged so that the web is strained in a crossmachine direction and increases in width between the first edge of the web and a selected position on the web spaced toward the centerline of the web by action of the first rotating shell;

wherein the rotating roll is divided into a plurality of separate suction zones, arrayed one after the other in the crossmachine direction which are selectively connectable to a source of suction; and wherein the separate suction zones form a means for holding the web to the rotating device so that strain in the web is limited to a selected portion of the web between a selected suction zone and the first edge of the web.

21. The apparatus of claim 20 further comprising a papermaking machine drying section having a portion applying single-wire transfer and wherein the apparatus is located in said drying section.

22. The apparatus of claim 20 further comprising a papermaking machine drying section having a portion applying two-wire transfer and wherein the apparatus is located in said drying section.

23. The apparatus of claim 20 wherein the end piece shell is rotatably mounted to an end of the rotating device, and is mounted so that the axis of rotation tilt with respect to the axis of rotation of the rotating device can be varied.

24. The apparatus of claim 20 wherein the end piece shell rotatably mounted to an end of the rotating device is pivotally mounted to the rotating device and incorporates a motor arranged to drive the end piece shell.

25. The apparatus of claim 20 wherein the first rotating shell is supported by a pivot, whereby the pivot is arranged such that the pivoting of the shell is about a point on an edge of the shell closest to the rotating device.

26. The apparatus of claim 20 wherein the first rotating shell is perforated through the shell and opens into grooves on an outer surface of the shell.

27. The apparatus of claim 26, wherein the grooves are straight grooves extending parallel to the rotation axis of the shell.

28. The apparatus of claim 20 wherein:

the web is supported on top of a fabric or drying wire so that the web is underlain by the fabric or drying wire as it is wrapped about the selected angle of the rotating roll; and wherein the web is not supported on top of a fabric or drying wire on the first rotating shell, which first rotating shell has a diameter which compensates for the thickness of the fabric or drying wire.

29. The apparatus of claim 20 wherein the first rotating shell mounted to the first end part of the rotating roll has an independent drive, such that it can rotate faster than the rotating roll.

30. The apparatus of claim 20 wherein the first shell is divided into a plurality of circumferential vacuum zones.

* * * * *